US011635720B2

(12) United States Patent
Yamamura

(10) Patent No.: US 11,635,720 B2
(45) Date of Patent: Apr. 25, 2023

(54) IMAGE FORMING APPARATUS

(71) Applicant: Hiroki Yamamura, Tokyo (JP)

(72) Inventor: Hiroki Yamamura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/492,675

(22) Filed: Oct. 4, 2021

(65) Prior Publication Data

US 2022/0113663 A1 Apr. 14, 2022

(30) Foreign Application Priority Data

Oct. 14, 2020 (JP) ..... JP2020-173359

(51) Int. Cl.
*G03G 15/00* (2006.01)
*G03G 21/18* (2006.01)

(52) U.S. Cl.
CPC ..... *G03G 15/5025* (2013.01); *G03G 15/502* (2013.01); *G03G 15/5054* (2013.01); *G03G 15/5062* (2013.01); *G03G 21/1875* (2013.01); *G03G 21/1889* (2013.01)

(58) Field of Classification Search
CPC ..... G03G 15/5025; G03G 15/502; G03G 15/5054; G03G 15/5062; G03G 21/1875; G03G 21/1889
See application file for complete search history.

(56) References Cited

U.S. PATENT DOCUMENTS

2005/0036799 A1* 2/2005 Tomita ..... G03G 15/50 399/49
2005/0095017 A1 5/2005 Kikuchi
2011/0013916 A1 1/2011 Katoh
2018/0348701 A1 12/2018 Inoue
2018/0364630 A1 12/2018 Hamatsu et al.
2019/0163108 A1 5/2019 Sakurada et al.
2020/0301326 A1 9/2020 Yamazaki et al.

FOREIGN PATENT DOCUMENTS

JP 2005-010583 1/2005
JP 2006-078796 3/2006
JP 2019-003134 1/2019

OTHER PUBLICATIONS

Extended European Search Report dated Mar. 14, 2022 in European Patent Application No. 21199225.0, 6 pages.

* cited by examiner

*Primary Examiner* — Susan S Lee
(74) *Attorney, Agent, or Firm* — Xsensus LLP

(57) ABSTRACT

An image forming apparatus includes image forming units having unit identification data, unit attachment portions having attachment portion identification data, an acquisition unit, a calculator, a storage unit, a controller, and a notification unit. The acquisition unit acquires data set of the two types of data. The calculator calculates data that are correction data for correcting image forming conditions or data on corrected image forming conditions. The storage unit stores the data set and the calculation data corresponding to the data set. The controller executes a data reuse control of controlling the image forming units using the calculation data that are stored in the storage unit and correspond to the data set after the data set is changed. The notification unit notifies execution-related information on execution of the data reuse control before the data reuse control.

18 Claims, 18 Drawing Sheets

FIG. 13

608

NOTIFICATION

TYPE OR POSITION OF PROCESS CARTRIDGE HAS BEEN CHANGED.
DO YOU WANT TO APPLY RECENT ADJUSTMENT DATA OF CHANGED ARRANGEMENT?
(RECENT ADJUSTMENT DATE: YYYY/MM/DD TIME: hh:mm)
(IF YOU WANT PERFORMING ADJUSTMENT, PLEASE TOUCH "NO".)

YES NO

☐ DO NOT ASK AGAIN
(PLEASE CHECK THE ABOVE BOX TO APPLY RECENT ADJUSTMENT DATA WHEN TYPE OR POSITION OF PROCESS CARTRIDGE IS CHANGED IN FUTURE.)

IMAGE FORMING APPARATUS

CROSS-REFERENCE TO RELATED APPLICATION

This patent application is based on and claims priority pursuant to 35 U.S.C. § 119 to Japanese Patent Application No. 2020-173359, filed on Oct. 14, 2020 in the Japan Patent Office, the entire disclosure of which is hereby incorporated by reference herein.

BACKGROUND

Technical Field

Embodiments of the present disclosure relate to an image forming apparatus.

Related Art

There is an image forming apparatus including a plurality of image forming units detachably attached to a plurality of unit attachment portions in an apparatus main body.

For example, there is an image forming apparatus including two image forming units using a gold toner and a transparent toner in addition to four image forming units using toners of four colors of cyan, magenta, yellow, and black. The six image forming units are detachably attached to six attachment positions. This image forming apparatus is configured such that a user can freely change the attachment position of the image forming unit.

A control device in the image forming apparatus acquires a data set of unit identification data of the image forming units and attachment position data regarding the attachment positions of the image forming units and stores image forming condition data that are parameters depending on positions of the image forming units and colors of images formed by the image forming units in a memory in association with the corresponding data set. When one image forming unit attached at a certain attachment position is attached at another attachment position, the control device reads the parameters depending on the positions and colors related to the data set including the unit identification data of the one image forming unit and the attachment position data regarding another attachment position from the memory. Then, the controller uses the read parameters to perform an image formation control of the image forming unit attached to another attachment position. Thus, the image forming apparatus forms an image.

SUMMARY

This specification describes an improved image forming apparatus that includes a plurality of image forming units, a plurality of unit attachment portions, an acquisition unit, a calculator, a storage unit, a controller, and a notification unit. The plurality of image forming units has unit identification data. The plurality of unit attachment portions has attachment portion identification data. The plurality of image forming units detachably attached to the plurality of unit attachment portions. The acquisition unit is configured to acquire data set of the unit identification data of the plurality of image forming units and the attachment portion identification data of the plurality of unit attachment portions. The calculator is configured to calculate calculation data that include at least one of correction data for correcting image forming conditions of the plurality of image forming units or data on corrected image forming conditions. The storage unit is configured to store the data set and the calculation data corresponding to the data set so as to be related to each other. The controller is configured to execute a data reuse control of controlling the plurality of image forming units using the calculation data that are stored in the storage unit and correspond to the data set acquired by the acquisition unit after the data set is changed. The notification unit is configured to notify execution-related information on execution of the data reuse control before the controller executes the data reuse control.

This specification further describes an improved image forming apparatus that includes the plurality of image forming units, the plurality of unit attachment portions, the acquisition unit, a calculator, the storage unit, and a controller. The calculator is configured to calculate the calculation data without receiving an instruction input when the storage unit does not store the calculation data corresponding to the data set acquired by the acquisition unit after the data set is changed. The controller is configured to control the plurality of image forming units using the calculation data.

This specification further describes an improved image forming system that includes an image forming apparatus, the acquisition unit, the calculator, the storage unit, and the controller. The image forming apparatus includes the plurality of image forming units and the plurality of unit attachment portions. The calculator is configured to calculate calculation data that include at least one of correction data for correcting image forming conditions of the plurality of image forming units or data on corrected image forming conditions. The storage unit is configured to store the data set and the calculation data corresponding to the data set so as to be related to each other. The controller is configured to execute a data reuse control of controlling the plurality of image forming units using the calculation data that are stored in the storage unit and correspond to the data set acquired by the acquisition unit after the data set is changed. The notification unit is configured to notify execution-related information on execution of the data reuse control before the controller executes the data reuse control.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 11 including

FIG. 13 is an explanatory diagram illustrating an example of a message screen displayed in a process of step S207 in the second variation;

Figure 1:
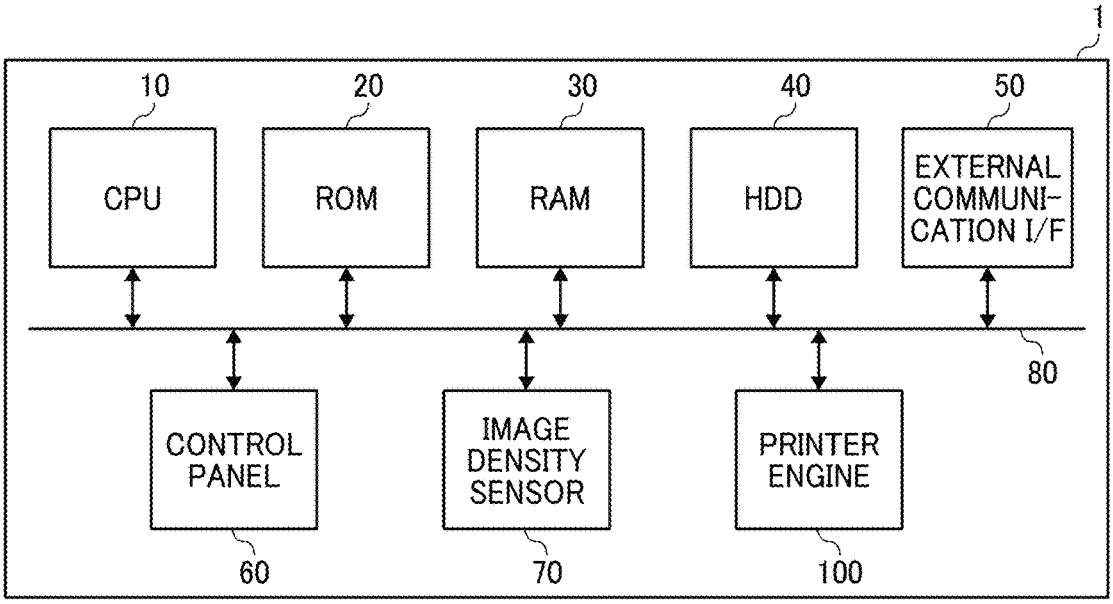
FIG. 1 is a block diagram illustrating a hardware configuration related to control of an image forming apparatus according to an embodiment of the present disclosure.

The accompanying drawings are intended to depict embodiments of the present disclosure and should not be interpreted to limit the scope thereof The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

A description is provided of an image forming apparatus according to the present disclosure with reference to drawings. It is to be noted that the present disclosure is not to be considered limited to the following embodiments but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

The following describes an image forming apparatus according to an embodiment of the present disclosure.

FIG. 1 is a block diagram illustrating a hardware configuration related to control of the image forming apparatus according to the embodiment of the present disclosure.

As illustrated in FIG. 1, the image forming apparatus 1 according to the present embodiment includes a central processing unit (CPU) 10 functioning as a correction unit (or circuitry), a read only memory (ROM) 20, a random access memory (RAM) 30. Additionally, the image forming apparatus 1 includes a hard disc drive (HDD) 40, an external communication interface (I/F) 50, a control panel 60, a printer engine 100, and an image density sensor 70. A system bus 80 interconnects the above-described elements.

The CPU 10 controls operation of the image forming apparatus 1. Specifically, the CPU 10 executes programs stored in the ROM 20 or the HDD 40, using the RAM 30 as a work area to control the operations of the entire image forming apparatus 1 and implement various functions, such as copying, scanning, faxing, and printing. The CPU 10 also functions as an image quality adjustment unit that performs image quality adjustment control of an image to be formed by executing a program stored in the ROM 20 or the HDD 40.

The ROM 20 is a nonvolatile semiconductor memory that can retain data even when a power source is turned off. The RAM 30 is a volatile semiconductor memory that temporarily stores a program or data. The HDD 40 is a nonvolatile memory that stores programs or data. Programs and data stored in the HDD 40 include an operating system (OS), which is basic software for controlling the entire image forming apparatus 1, various application programs operating on the OS, and operation conditions of various functions. The HDD 40 can further store operations of such various functions (hereinafter also "jobs"), including operations of the image forming apparatus 1 and so on, each time each job is executed.

The external communication I/F 50 is an interface to connect the image forming apparatus 1 to a network, such as the Internet or a local area network (LAN). The image forming apparatus 1 can receive a print instruction, image data, and the like from external devices via the external communication I/F 50.

The control panel 60 serves as an input receiving unit to receive various types of instruction input according to the user's operation and as a display that is a notification unit displaying various types of information (for example, information indicating the received operation, information indicating the operation status of the image forming apparatus 1, or information indicating the setting status of the image forming apparatus 1). In one example, the control panel 60 is, but not limited to, a liquid crystal display (LCD) having a touch panel function. Another example usable is an organic electro luminescence (EL) display having a touch panel function. In addition to or instead of the above-described control panel 60, an operation device such as a hardware key or a display device such as a lamp may be provided. In addition to the LCD, the EL display, and the lamp described above, the notification unit may be a general display. Alternatively, the notification unit may be a device that notifies information using voice or sound such as a speaker. In addition to the above-described touch panel, the input receiving unit may be a mechanic keyboard or a voice input device, or the like. The notification unit may be circuitry transmitting information notified to a user to the external device such as a personal computer. The input receiving unit may be circuitry receiving the instruct input sent from the external device such as the personal computer. The control panel 60 is controlled by the CPU 10.

A printer engine 100 as an image forming device is hardware for realizing a printer function, a copy function, a facsimile function, and the like, and functions as an image forming device that forms an image on a sheet as a recording medium. As the printer function, an electrophotographic method, an inkjet method, or the like can be applied, but the printer function is not limited thereto. The image forming apparatus 1 can further include optional devices, such as a finisher to sort printed sheets and an automatic document feeder (ADF) to automatically feed documents. The printer engine 100 is controlled by the CPU 10 as the controller.

The image forming apparatus 1 may also include an external interface to read and write an external storage medium, such as a compact disc (CD), a digital versatile disc (DVD), a secure digital (SD) memory card, or a universal serial bus (USB) memory, via the external interface.

The programs stored in the ROM 20 or the HDD 40 can be processed by a computer. The programs may be installed in the ROM 20 or the HDD 40 at the time of manufacture or shipment of the image forming apparatus 1 or may be installed after sale. As a method of installing programs after sale, for example, the programs can be installed via an external storage medium drive using an external storage medium storing the programs or via a network using the external communication I/F 50.

Figure 2:
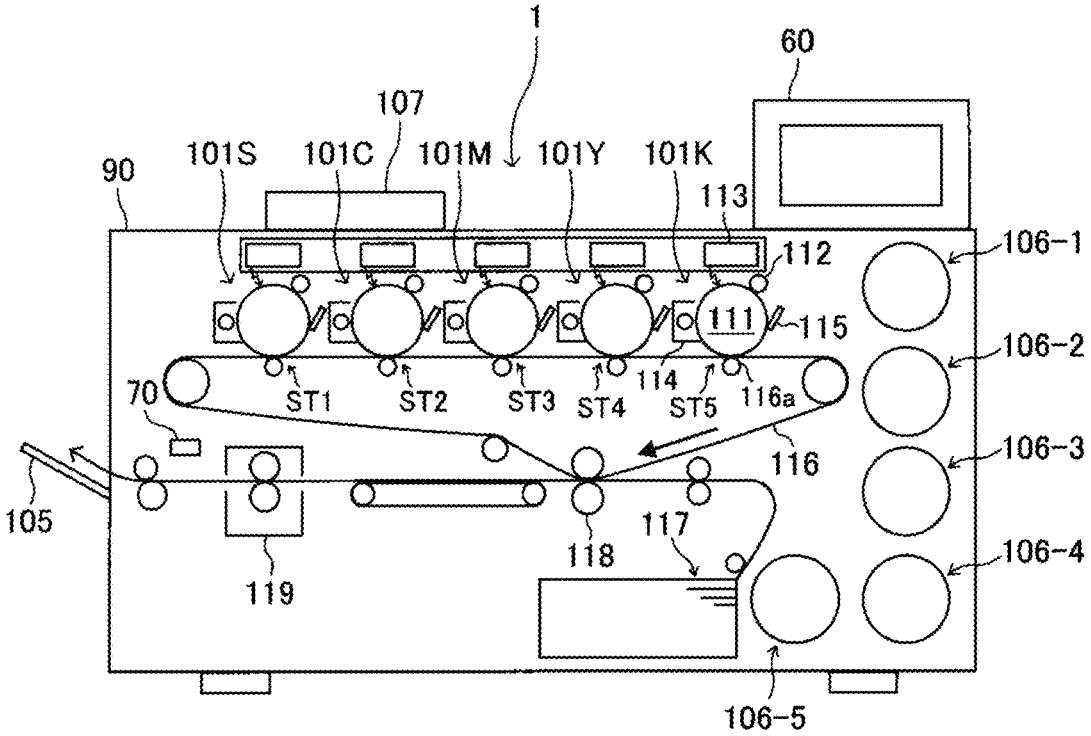
FIG. 2 is a schematic diagram illustrating a hardware configuration of a printer engine in the image forming apparatus of FIG. 1.

FIG. 2 is a schematic diagram illustrating a hardware configuration of the printer engine 100.

The printer engine 100 is disposed inside a housing 90 of the image forming apparatus 1 and includes five image forming units 101S, 101C, 101M, 101Y and 101K that are process cartridges. These five image forming units include four image forming units 101C, 101M, 101Y, and 101K using cyan (C) toner, magenta (M) toner, yellow (Y) toner, and black (K) toner, respectively and one image forming unit 101S using toner having a color other than the above colors (hereinafter referred to as "spot color toner"). Examples of the spot color toner include transparent toner, white toner, and gold toner. A plurality of image forming units using these different spot color toners may be prepared and selectively installed in the image forming apparatus 1.

The image forming units 101S, 101C, 101M, 101Y, and 101K have the same mechanical configuration except that the image forming units use different colors of toner. Each of the image forming units 101S, 101C, 101M, 101Y, and 101K includes a photoconductor 111 as a latent-image bearer, a charger 112 as a charging device, a developing device 114, and a cleaner 115 as a cleaning device. FIG. 2 illustrates the photoconductor, the charger, the developing device, and the cleaner with reference numerals only in the image forming unit 101K attached to the most downstream station ST5 which is the rightmost attachment position in FIG. 2.

The image forming apparatus 1 includes a writing device 113 as a latent image forming unit above the image forming units 101S, 101C, 101M, 101Y, and 101K inside the housing 90 of the image forming apparatus 1. The image forming apparatus 1 includes bottle attachment portions 106-1 to 106-5 inside the housing 90 of the image forming apparatus 1 so that five toner bottles can be attached. The toner bottles are containers for toner to be replenished to the developing devices 114.

The image forming apparatus 1 includes an intermediate transfer belt 116 serving as an intermediate transferor below the five image forming units 101S, 101C, 101M, 101Y, and 101K. Primary transfer devices 116*a* are disposed facing the image forming units 101S, 101C, 101M, 101Y, and 101K inside a loop of the intermediate transfer belt 116. The image forming apparatus 1 includes a secondary transfer device 118 facing the surface of the intermediate transfer belt 116. The image forming apparatus also includes a sheet feeder 117, a fixing device 119, an output tray 105. The sheet feeder 117 sends a sheet between the intermediate transfer belt 116 and the secondary transfer device 118. The fixing device 119 fixes the toner image on the sheet to which the toner image has been transferred from the intermediate transfer belt 116 by the secondary transfer device 118. The sheet bearing the fixed toner image is ejected from the image forming apparatus 1 and received by the output tray 105. A document reading device 107 and the control panel 60 are disposed on the housing 90 of the image forming apparatus 1.

Figure 18A:
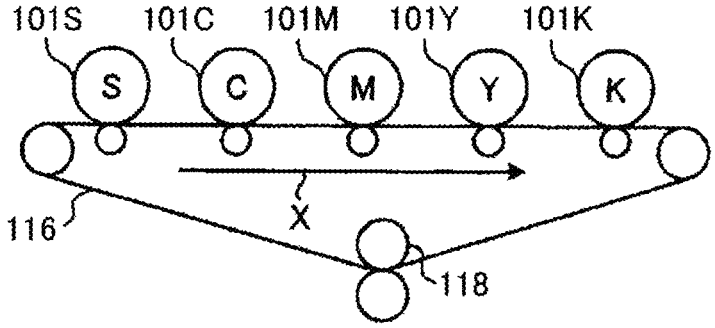
FIGS. 18A and 18B are schematic diagrams illustrating an example in which the image forming units disposed in the most upstream station and the most downstream station are exchanged with each other.
Figure 18B:
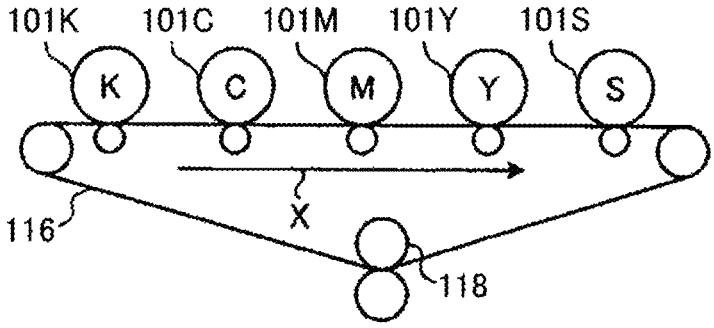

In the image forming apparatus 1 according to the present embodiment, the image forming unit 101S to form a white toner image can be set on either the most upstream station ST1 or the most downstream station ST5. That is, in the example illustrated in FIG. 2, the image forming unit 1015 is attached to the most upstream station ST1. However, as illustrated in FIGS. 18A and 18B, the image forming unit 101S and the image forming unit 101K may be exchanged to set the image forming unit 101S to the most downstream station ST5.

The transparent toner as the spot color toner used to improve glossiness of the toner image is preferably layered as the uppermost layer of toner layers transferred onto the sheet and superimposed on the sheet to form the toner image. To form the uppermost transparent toner layer, the image forming unit 101S using the transparent toner is preferably set to the most upstream station ST1 that forms the lowest layer of the toner layers on the intermediate transfer belt 116.

The white toner as the spot color toner used to whiten the ground color of the sheet is preferably layered as the lowermost layer of toner layers transferred onto the sheet and superimposed on the sheet to form the toner image. To form the lowermost white toner, the image forming unit 101S using the white toner is preferably set to the most downstream station ST5 that forms the uppermost layer of the toner layers on the intermediate transfer belt 116. On the other hand, forming the uppermost white toner layer may be preferable when the ground color of the sheet is different or when the white toner is used for another application. In this case, the image forming unit 101S using the white toner is preferably set to the most upstream station ST1 that forms the lowest layer of the toner layers on the intermediate transfer belt 116.

The gold toner as the spot color toner used to highlight a gold color is preferably layered as the uppermost layer of toner layers transferred onto the sheet and superimposed on the sheet to form the toner image. To form the uppermost gold toner layer, the image forming unit 101S using the gold toner is preferably set to the most upstream station ST1 that forms the lowest layer of the toner layers on the intermediate transfer belt 116.

Replacing the image forming unit 101S for the spot color toner may cause changing a station position to which the image forming unit 101S is set. In this case, the station position of the image forming unit 101S is preferably replaced with the station position of the image forming unit 101K using the black toner, and the station position of the image forming unit 101K is set to the most upstream station ST1 or the most downstream station ST5. Since replacing the station position of the image forming unit 101S with the station position of the image forming unit 101K does not change the station positions of the image forming units 101C, 101M, and 101Y, the image forming units 101C, 101M, and 101Y may be configured to be attachable only to the respective stations ST2, ST3, and ST4.

In the present embodiment, the image density sensor 70 detects the image density of the image on the sheet ejected from the fixing device 119. Although details of the image density sensor 70 are described below, image forming conditions of the image forming units 101S, 101C, 101M, 101Y, and 101K are corrected based on the image densities detected by the image density sensor 70.

The image density sensor 70 is disposed so as to detect the image density on the sheet ejected from the fixing device 119 in FIG. 2 but may be disposed at another location to detect the image density. For example, the image density sensor 70 may be disposed upstream from the fixing device 119 in a sheet conveyance direction and downstream from the secondary transfer device 118 in the sheet conveyance direction to detect the image density of the toner image on the sheet before the fixing device fixes the toner image onto the sheet. Alternatively, the image density sensor 70 may be disposed near the secondary transfer device 118 to detect the image density of the toner image formed on the intermediate transfer belt 116.

Figure 3:
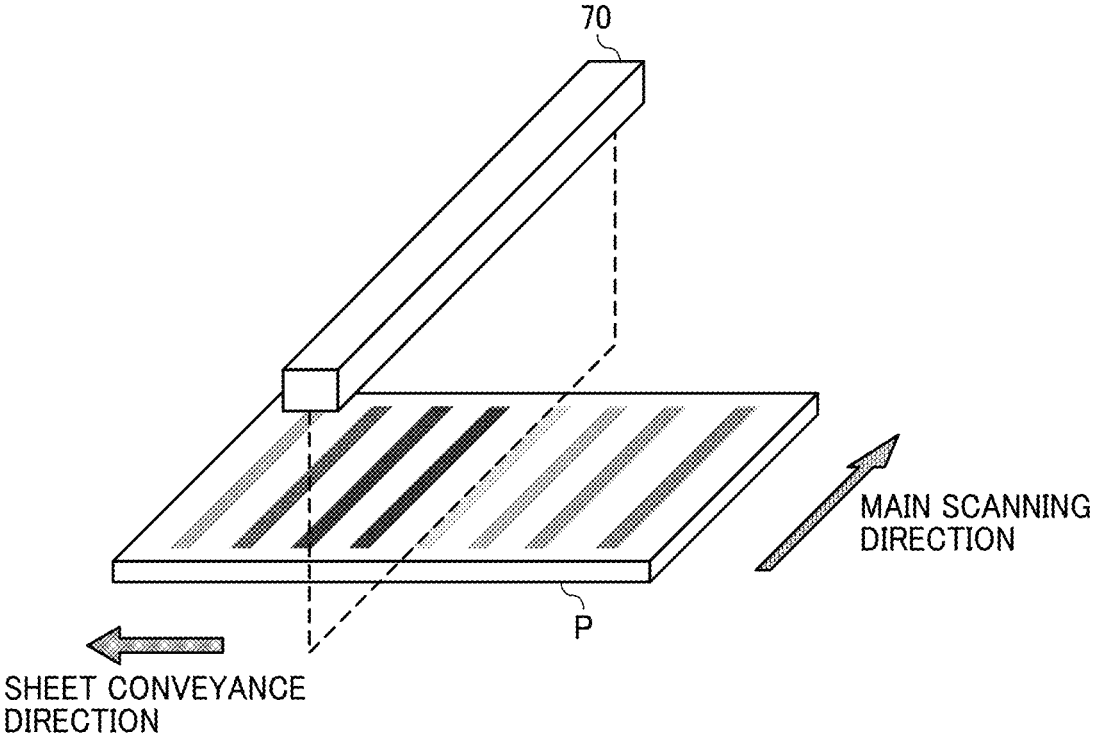
FIG. 3 is a perspective view of an example of an image density sensor in the image forming apparatus of FIG. 1.

FIG. 3 is a perspective view of an example of the image density sensor 70.

As illustrated in FIG. 3, the image density sensor 70 is a line sensor elongated in the main scanning direction, and an image element elongated in the main scanning direction is provided inside the image density sensor 70. The detection width of the image density sensor 70 in the main scanning direction is a width indicated by a dashed line in the main scanning direction in FIG. 3. The detection width is longer than the width of the sheet P in the main scanning direction. Accordingly, when the sheet P is conveyed so as to pass through the width indicated by the dashed line in the main scanning direction, the image density can be detected over the entire area of the sheet P. In other words, the image density sensor 70 in FIG. 3 can also detect the density of the right end portion, the left end portion, the leading end portion in the sheet conveyance direction, and the trailing end portion in the sheet conveyance direction of the sheet P. FIG. 3 illustrates an example of the image density sensor 70 in which the detection width in the main scanning direction is longer than the width of the sheet P in the main scanning direction. Note that the detection width is not limited thereto, and for example, a detection width shorter than the width of the sheet P in the main scanning direction may be used.

Figure 4A:
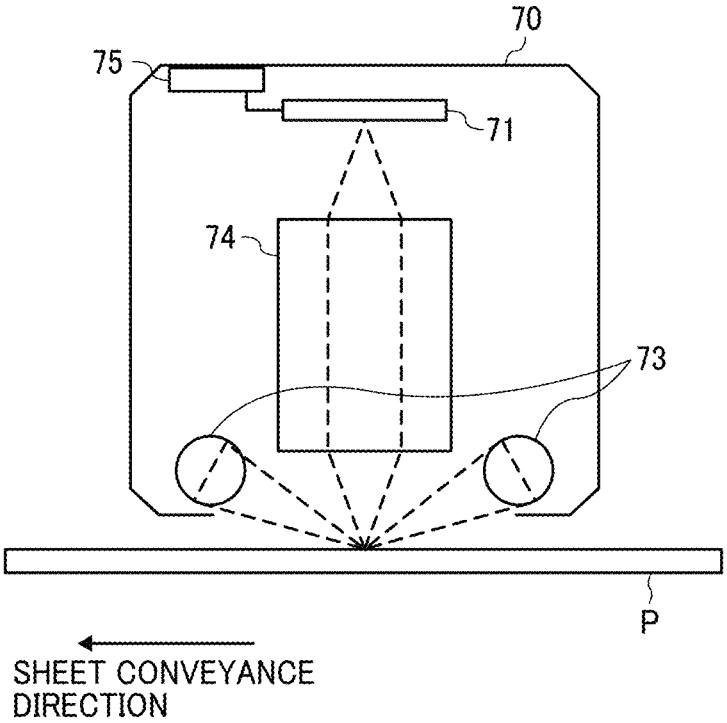
FIG. 4A is a cross-sectional view of the image density sensor of FIG. 3 taken along a cross section orthogonal to a main scanning direction.

FIG. 4A is a cross-sectional view of the image density sensor 70 taken along a cross section orthogonal to the main scanning direction.

As illustrated in FIG. 4A, the image density sensor 70 includes the above-described image element 71, light sources 73, a lens array 74, and an output circuit 75. The dashed lines represent the light emitted from the light sources 73.

Figure 4B:
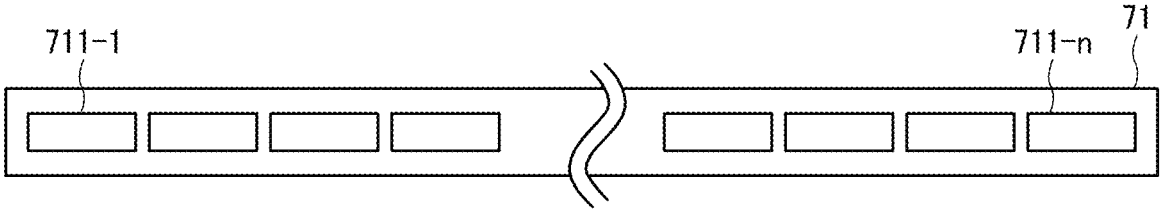
FIG. 4B is a schematic configuration diagram of an image element included in the image density sensor of FIG. 4A.

FIG. 4B is a schematic diagram of a configuration of an image element included in the image density sensor 70.

As illustrated in FIG. 4B, the image element 71 extends in the main scanning direction and includes small light-receiving elements 711-1 to 711-*n* (hereinafter collectively "light-receiving elements 711" when discrimination is not necessary) arranged side by side in the main scanning direction. The range in which the light receiving elements 711 are arranged is the detection width of the image density sensor 70 in the main scanning direction.

As the light source 73, a light source in which a light emitting element is provided at an end portion of a light guide body, an LED array, or the like can be used. The light sources 73 emit light of red, green, and blue (RGB). As the lens array 74, for example, a SELFOC (registered trademark) lens is used. The light emitted from the light source 73 is reflected on the sheet P and is imaged by the lens array 74. Each light-receiving element 711 illustrated in FIG. 4B receives the light imaged by the lens array 74, and the image element 71 outputs a signal corresponding to the received light. A complementary metal oxide semiconductor (CMOS) sensor or a charge-coupled device (CCD) sensor, for example, may be used as the image element 71.

The output circuit 75 may be, for example, an application specific integrated circuit (ASIC) or the like. The output circuit 75 converts the signal from each light receiving element 72 on the image element 71 into data indicating image density corresponding to the position of an image pattern on the sheet P and outputs the data. For example, 0 to 255 gradations represented by 8 bits are output.

Next, the image forming units 1015, 101C, 101M, 101Y, and 101K are described with reference to the drawings.

Since the mechanical configuration of each image forming unit is common as described above, color codes S, C, M, Y, and K are appropriately omitted in the following description.

Figure 5A:
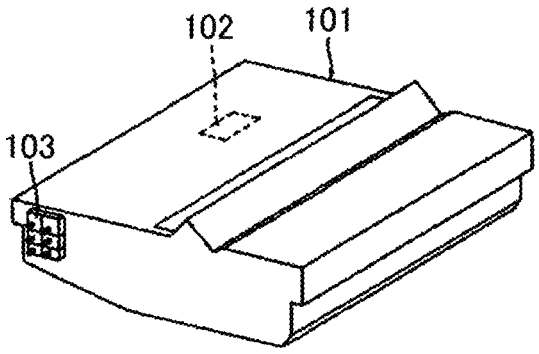
FIG. 5A is a perspective view of an image forming unit of the image forming apparatus of FIG. 1.

FIG. 5A is a perspective view of the image forming unit 101 according to the present embodiment.

Figure 5B:
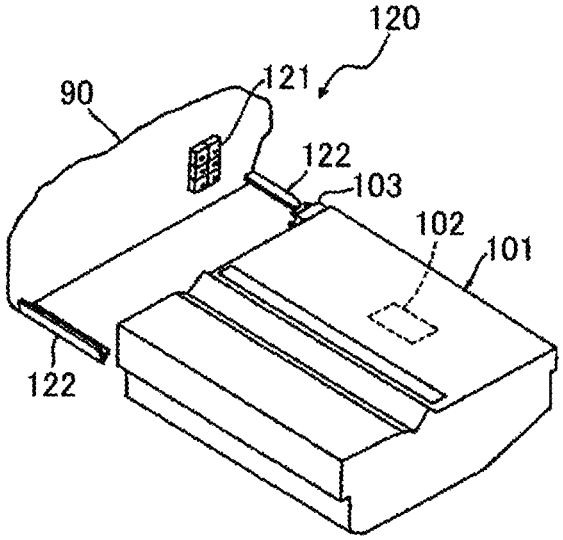
FIG. 5B is a perspective view of the image forming unit of FIG. 5A and a unit attachment portion disposed in a station to set the image forming unit of FIG. 5A.

FIG. 5B is a perspective view of the image forming unit 101 and a unit attachment portion 120 disposed in the station ST to set the image forming unit 101.

The image forming unit 101 according to the present embodiment is a unit that integrally supports the photoconductor 111, the charger 112, the developing device 114, and the cleaner 115. However, the image forming unit 101 according to the present embodiment may be a unit that integrally supports at least one of the photoconductor 111, the charger 112, the developing device 114, and the cleaner 115.

The image forming unit 101 includes an Electrically Erasable Programmable Read Only Memory (EEPROM) 102 that is a non-volatile storage medium as a storage unit, and a connector 103 for data transfer disposed on an end face of the image forming unit 101. Unit identification data (that is, individual identification data) capable of identifying each image forming unit 101 is written in the EEPROM 102. The EEPROM 102 may store correction data for the image forming conditions of the image forming units 101 or the corrected image forming conditions.

As illustrated in FIG. 5B, the unit attachment portion 120 disposed inside the housing 90 of the image forming apparatus 1 includes a data communication portion 121 and guides 122. The data communication portion 121 couples to a connector 103 of the image forming unit 101 to perform data communication. The guides 122 guide movement of the image forming unit 101 when the image forming unit 101 is installed in or removed from the image forming apparatus 1. When the image forming unit 101 is installed in the housing 90 of the image forming apparatus 1, the image forming unit 101 is inserted into the housing 90 along the guides 122 disposed in the unit attachment portion 120. As a result, the connector 103 of the image forming unit 101 is coupled to the data communication portion 121 disposed in the unit attachment portion 120.

Figure 6:
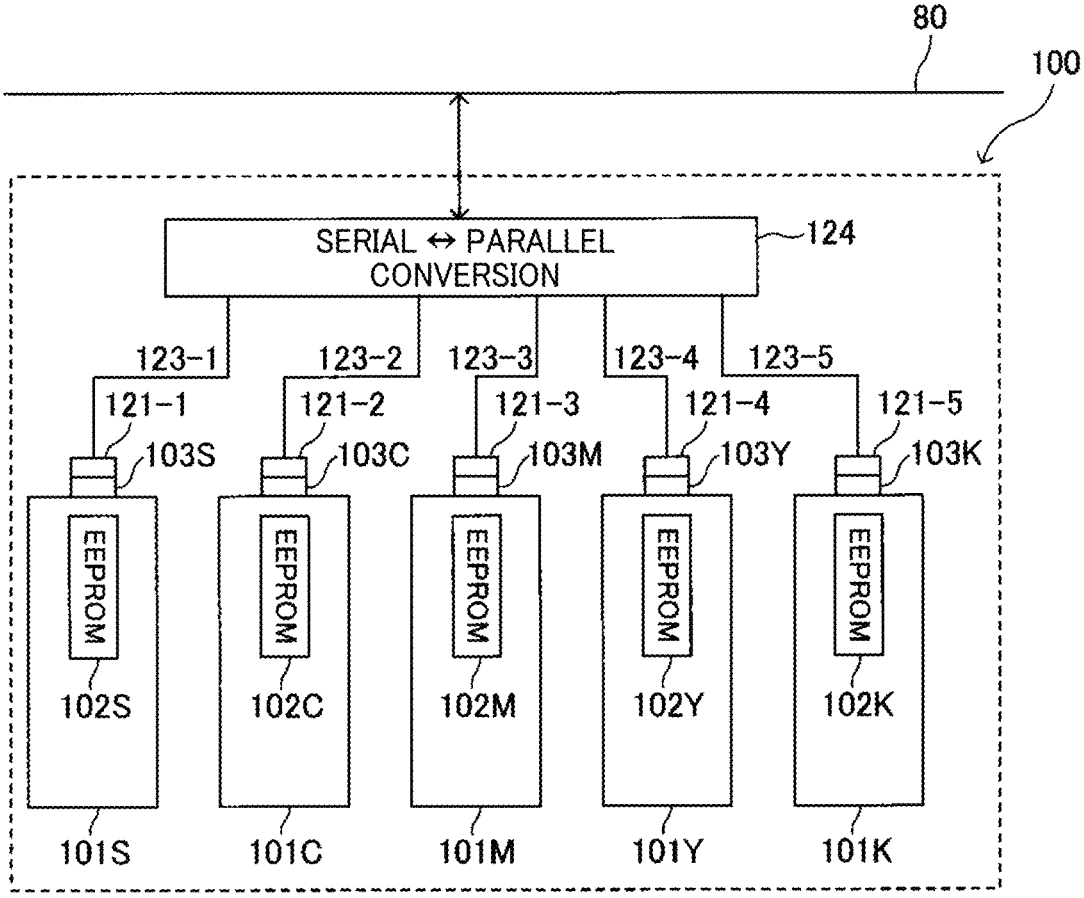
FIG. 6 is an explanatory view of a control system of the printer engine including image forming units disposed in unit attachment portions in a housing of the image forming apparatus of FIG. 1.

FIG. 6 is an explanatory view of a control system of the printer engine 100 including image forming units 101S, 101C, 101M, 101Y, and 101K disposed in unit attachment portions 120-1 to 120-5 in the housing 90 of the image forming apparatus 1.

The connectors 103S, 103C, 103M, 103Y, and 103K of the image forming units 101S, 101C, 101M, 101Y, and 101K are coupled to the data communication portions 121-1 to 121-5 of the unit attachment portions 120, respectively. A serial-parallel converter 124 performs data communication with the EEPROMs 102S, 102C, 102M, 102Y, and 102K in the imaging forming units 1015, 101C, 101M, 101Y, and 101K via the serial buses 123-1 to 123-5, respectively. As illustrated in FIG. 1, the serial-parallel converter 124 can communicate with the CPU 10 or the like via the system bus 80.

Figure 7:
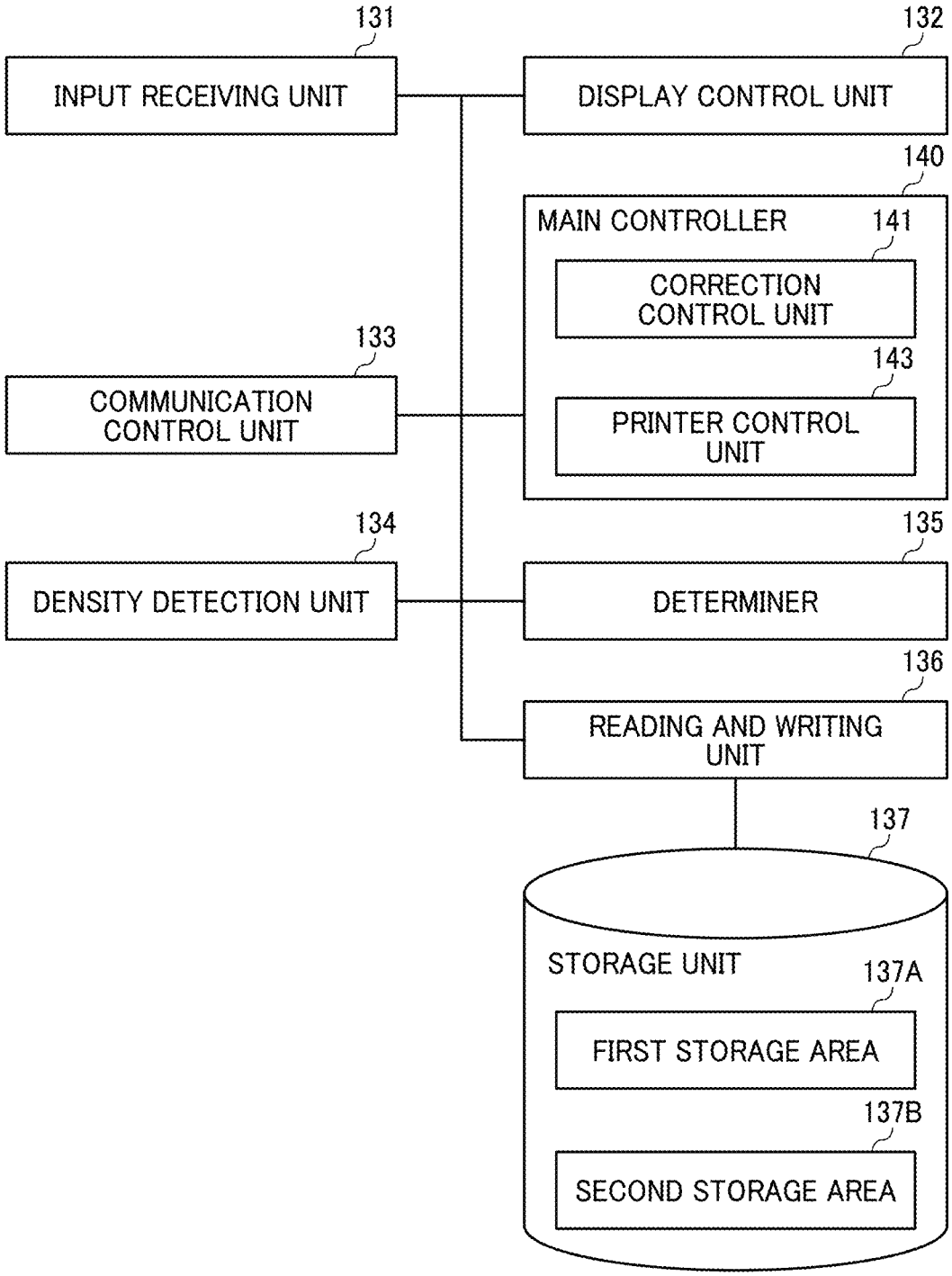
FIG. 7 is a functional block diagram illustrating main functions of the image forming apparatus of FIG. 1.

FIG. 7 is a functional block diagram illustrating main functions of the image forming apparatus 1 according to the present embodiment.

An input receiving unit 131 is implemented by the control panel 60. The input receiving unit 131 performs functions of displaying data necessary for operation to the user and receiving various instruction inputs made by the user. The input receiving unit 131 is also implemented by the processing of the external communication I/F 50 and performs functions of receiving a print instruction or a setting change instruction input by the user from an external device via a local area network (LAN) or the Internet.

A display control unit 132 is implemented by the CPU 10 executing a program stored in the ROM 20 or the HDD 40, using the RAM 30 as the work area. The display control unit 132 controls the control panel 60 to display a display screen.

A communication control unit 133 is implemented by the processing of the external communication I/F 50. The communication control unit 220 performs functions of transmitting image data to the outside via email or communicating with an external device via a network when various types of setting data can be set from the external device.

A main controller 140 is implemented by the CPU 10 executing a program stored in the ROM 20 or the HDD 40, using the RAM 30 as a work area. The main controller 140 performs functions of the entire image forming apparatus 1, for example, a copy function, a scanner function, a printer function, and a facsimile function. The main controller 140 includes a correction control unit 141, a correction amount calculation unit 182, and a printer control unit 143. The correction control unit 141 calculates an amount of correction (in other words, correction data) of image forming condition to correct an output image. The printer control unit 143 controls the printer engine 100.

A density detection unit 134 is implemented by the image density sensor 70. The density detection unit 134 performs functions of detecting the image density of the image formed by the image forming apparatus 1 and outputting detection results.

A determiner 135 acquires a data set of the unit identification data regarding the image forming units 1015, 101C, 101M, 101Y, and 101K and attachment portion identification data of the unit attachment portions 120-1 to 120-5 to which the image forming units are attached. Then, the determiner 135 determines which of the image forming units 1015, 101C, 101M, 101Y, and 101K is attached to which of the unit attachment portions 120-1 to 120-5 in the housing 90 of the image forming apparatus 1.

A reading and writing unit 136 is implemented by the CPU 10 executing a program stored in the ROM 20 or the HDD 40, using the RAM 30 as the work area. The reading and writing unit 136 stores various types of data in a storage unit 137 and retrieves the data stored therein.

The storage unit 137 is implemented by the ROM 20, the HDD 40, or the EEPROM 102 and performs functions of storing programs, data, image forming conditions and various setting information necessary for operations of the image forming apparatus 1, operation logs of the printer engine 100, and the like. Examples of the image forming conditions include a charging bias, a developing bias, an optical writing light amount, and a transfer bias.

The storage unit 137 includes a first storage area 137A and a second storage area 137B. The first storage area 137A stores the data set of the unit identification data to identify each of the image forming units 101S, 101C, 101M, 101Y, and 101K and the attachment portion identification data of the unit attachment portions 120-1 to 120-5 to which the image forming units are attached. The second storage area 137B stores the data set and the correction data of the image forming conditions corresponding to the data set that are related to each other. When the correction control unit 141 calculates the correction data, which is described below, the second storage area 137B stores the calculated correction data that is related to the data set regarding the calculation.

The various types of data stored in the storage unit 137 may be set before shipment of the image forming apparatus 1 or may be updated after shipment. Depending on the data to be stored, the storage unit 137 may be implemented by the temporary storage function of the RAM 30.

Figure 8:
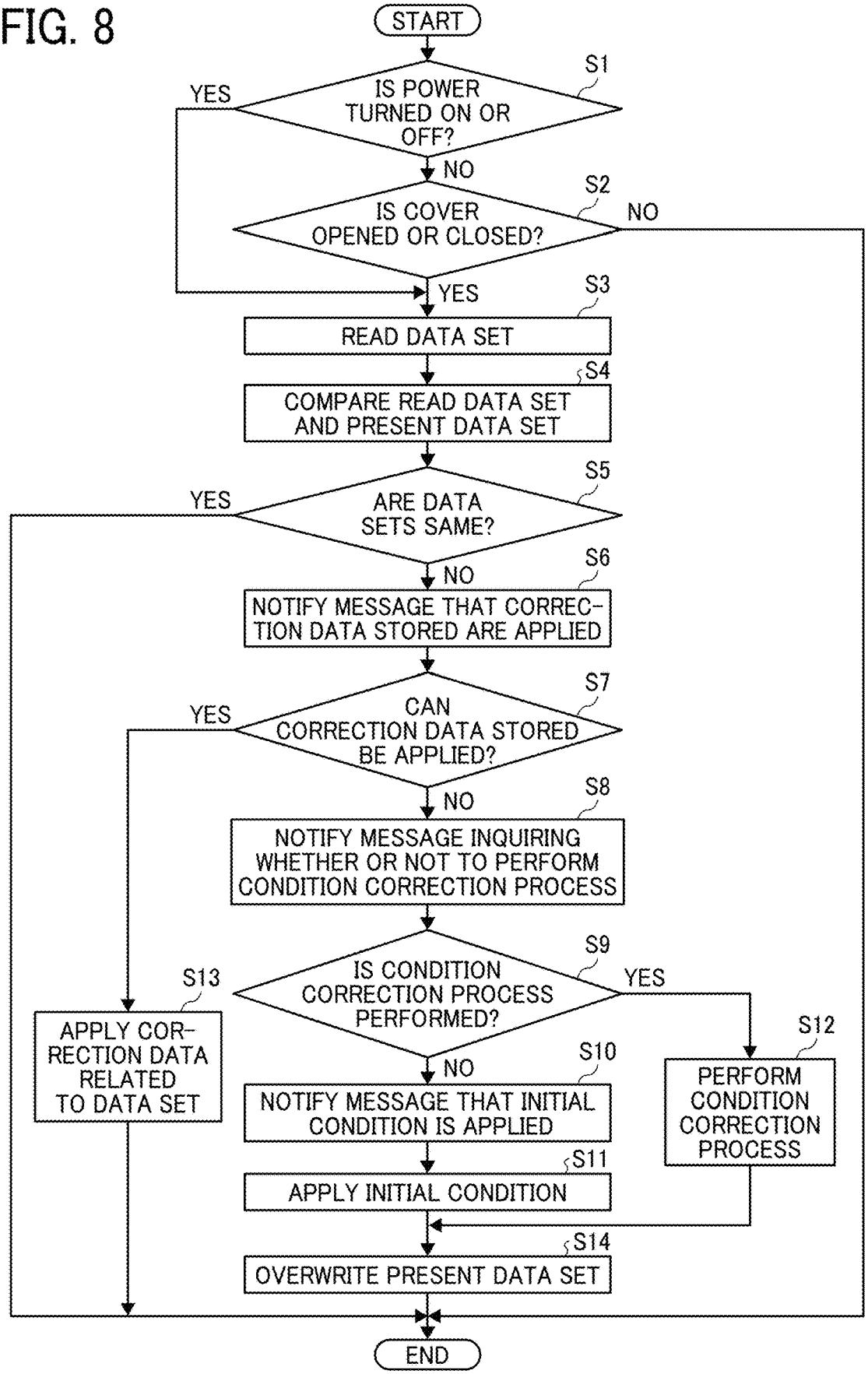
FIG. 8 is a flowchart illustrating processes of correcting image forming conditions according to the embodiment of the present disclosure.

FIG. 8 is a flowchart illustrating processes of correcting image forming conditions of the image forming apparatus 1 according to the embodiment of the present disclosure.

The reading and writing unit 136 of the image forming apparatus 1 functions as an acquisition unit for each event such as turning on or off power (step S1) or opening or closing a front cover (step S2). In the above event, the reading and writing unit 136 reads the data set of the unit identification data of each image forming unit attached to each unit attachment portion and the attachment portion identification data (position data of the stations ST) of the unit attachment portions on which the image forming units are attached in step S3. Then, the determiner 135 compares the read data set with present data set that is the currently applied data set stored in the first storage area 137A of the storage unit 137 in step S4.

When the determiner 135 determines that the read data set is the same as the present data set in the comparison of step S4 (Yes in step S5), the image forming condition correction processing ends. In contrast, when the determiner 135 determines that the read data set is not the same as the present data set (No in step S5), the display control unit 132 functions as the notification unit together with the control panel 60. In order to function as the notification unit, the display control unit 132 controls the control panel 60 to display a message as execution-related information for notifying the user that the correction data stored in the second storage area 137B of the storage unit 137 is applied in step S6.

Thereafter, the main controller 140 confirms whether or not the correction data related to the data set read in step S3 (the previously applied correction data corresponding to the read data set) is stored in the second storage area 137B of the storage unit 137. Then, the main controller 140 determines whether or not the previously applied correction data can be applied based on the confirmation result in step S7.

When the main controller 140 determines that the previously applied correction data can be applied in step S7 (Yes in S7), the reading and writing unit 136 reads the previously applied correction data related to the data set read in step S3 from the second storage area 137B of the storage unit 137. Next, in step S13, the main controller 140 applies the read previously applied correction data, and the printer control unit 143 controls the subsequent image forming operations using the image forming conditions corrected by the previously applied correction data, in other words, performs a data reuse control.

On the other hand, when the main controller 140 determines that the previously applied correction data cannot be applied in step S7 (No in step S7), the display control unit 132 functions as the notification unit together with the control panel 60. In step S8, the display control unit 132 controls the control panel 60 to display a message as the execution-related information for inquiring the user whether or not to execute condition correction processing for calculating the correction data of the image forming conditions.

When the user confirms the message displayed on the control panel 60 and operates the control panel 60 to instruct not to execute the condition correction processing (No in step S9), the display control unit 132 functions as the notification unit together with the control panel 60. In step S10, the display control unit 132 controls the control panel 60 to display a message as the execution-related information for notifying the user that initial setting data (data corresponding to the read data and being set at the time of factory shipment) is applied as the correction data for the image forming conditions. Next, in step S11, the main controller 140 applies the initial setting data as the correction data, and the printer control unit 143 controls the subsequent image forming operations using the image forming conditions corrected by the initial setting data. In addition, the reading and writing unit 136 writes the initial setting data as the correction data related to the data set read in step S3 in the second storage area 137B of the storage unit 137 in step S14.

On the other hand, when the user operates the control panel 60 and instructs to execute the condition correction processing (Yes in step S9), the correction control unit 141 in the main controller 140 performs the condition correction processing in step S12. The main controller 140 applies correction data newly calculated by the condition correction processing, and the printer control unit 143 controls the subsequent image forming operations using the image forming conditions corrected after the condition correction processing. In addition, the reading and writing unit 136 writes the correction data newly calculated in step S12 as the correction data related to the data set read in step S3 in the second storage area 137B of the storage unit 137 in step S14.

The notification method using the message or the like in the present embodiment is displaying the message on the control panel 60, but the notification method is not limited to this. For example, using a network, the message may be notified from the image forming apparatus 1 to a network connection terminal of the user such as the personal computer (PC).

Figure 9:
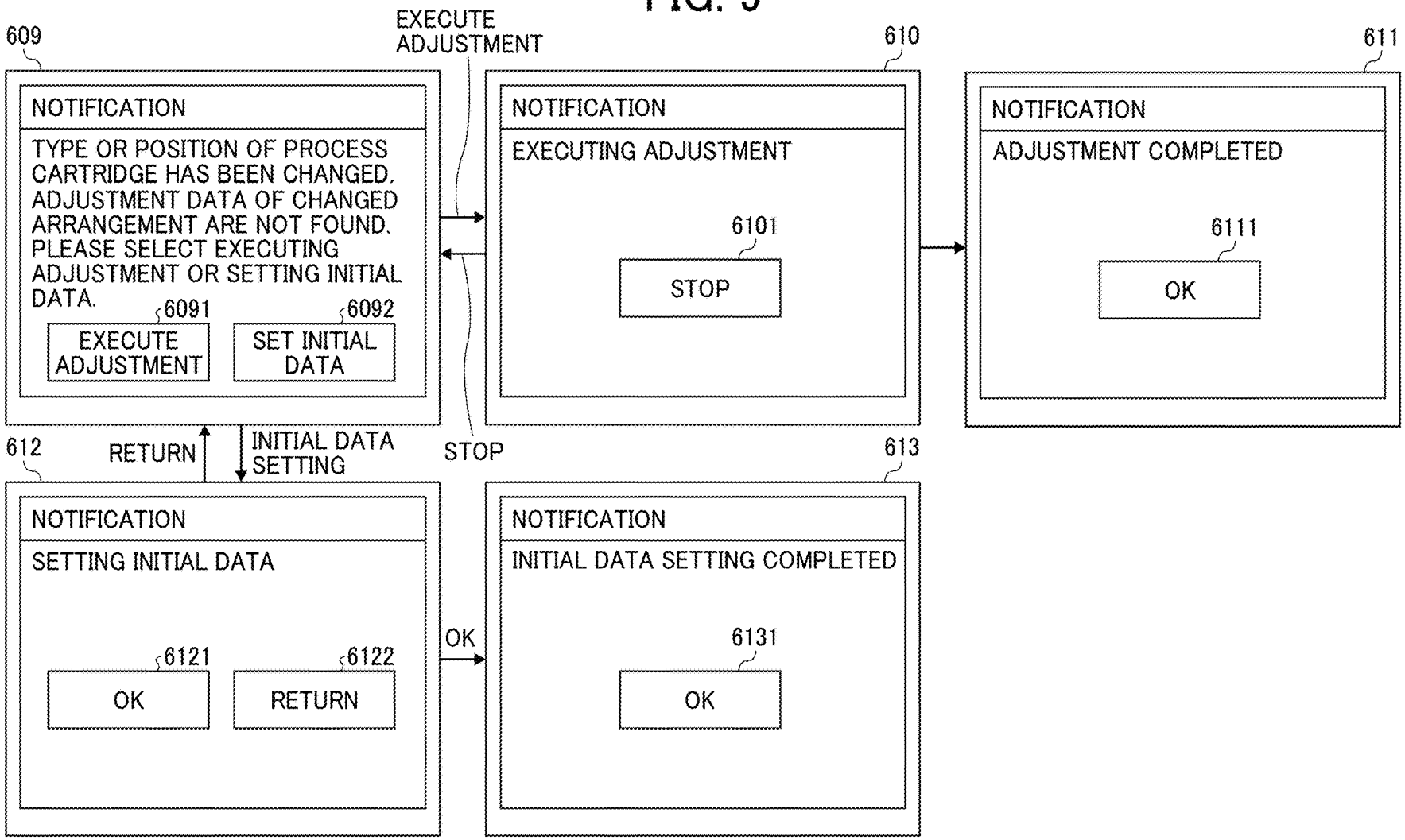
FIG. 9 is a transition diagram illustrating message screens displayed on a control panel in the embodiment.

FIG. 9 is a transition diagram illustrating a message screen displayed on the control panel 60 in the present embodiment.

A screen 609 is an example of the message notified in step S8. The message notified in step S8 may have a content of only inquiring whether or not to execute the correction (the condition correction processing). However, as illustrated in FIG. 9, the screen 609 preferably displays a warning message indicating that the correction data (in other words, adjustment values) related to the present data set do not exist in the storage unit 137. The above-described screen 609 can issue a warning, for example, when the image forming unit having no use history (for example, the image forming unit newly purchased by the user) is newly attached to any one of the unit attachment portions 120-1 to 120-5. The warning can prevent deterioration of the image quality that is caused by not performing the condition correction processing. In particular, since the user who uses the image forming apparatus 1 of the present embodiment capable of using the spot color toner often purchases an additional image forming unit for a new spot color toner, it is preferable to issue the warning as described above.

When the user touches an icon 6091 displaying "EXECUTE ADJUSTMENT" on the screen 609 (Yes in step S9), the correction control unit 141 in the main controller 140 performs the adjustment (the condition correction processing) in step S12, and the screen 609 transitions to a screen 610 notifying that adjustment is being executed. When the user touches an icon 6101 displaying "stop", the correction control unit 141 stops the adjustment operation being executed, and the screen 610 transitions to the screen 609. When the adjustment is completed without touching the "stop" icon 6101 on the screen 610, the screen 610 transitions to a screen 611 for notifying that the adjustment is completed. When the user touches an icon 6111 displaying "OK" on the screen 611, the screen 611 transitions to a home screen.

When the user touches an icon 6092 displaying "SET INITIAL DATA" on the screen 609 (No in step S9), the screen 609 transitions to a screen 612 confirming the user setting the initial data. When the user touches an icon 6122 displaying "RETURN" on the screen 612, the screen 612 transitions to the screen 609. When the user touches an icon 6121 displaying "OK" on the screen 612, the screen 612 transitions to a screen 613 informing the user setting the initial data. When the user touches an icon 6131 displaying "OK" on the screen 613, the screen 613 transitions to the home screen.

The following describes a first variation of the image forming condition correction processing according to the embodiment described above.

The image forming condition correction processing according to the first variation differs from the processing according to the above-described embodiment illustrated in FIG. 8 only in that the processes are changed depending on whether or not the previously applied correction data related to the read data set is stored in the second storage area 137B of the storage unit 137.

Figure 10:
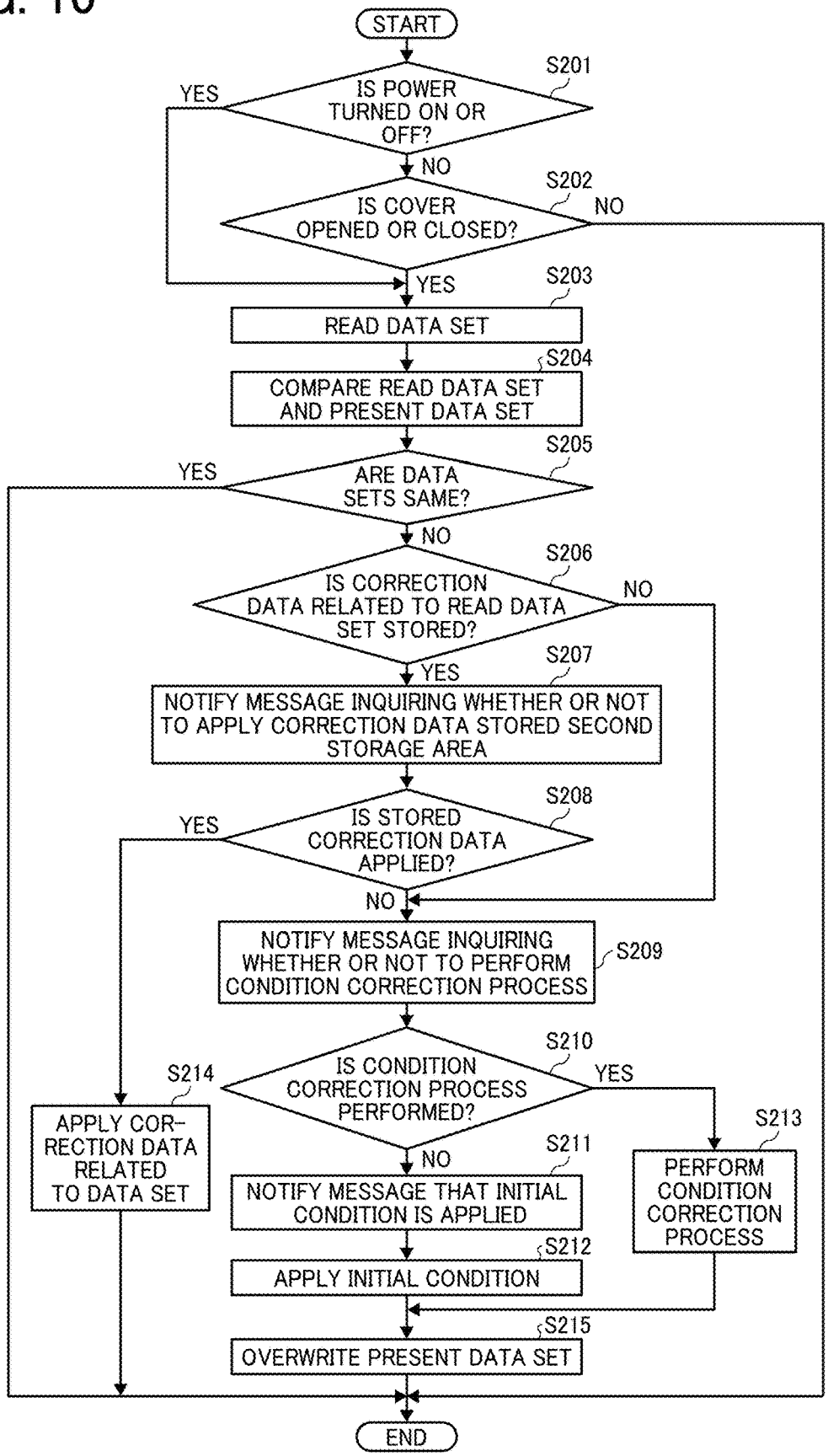
FIG. 10 is a flowchart illustrating processes of correcting image forming conditions according to a first variation.

FIG. 10 is a flowchart illustrating processes of correcting image forming conditions of the image forming apparatus 1 according to the first variation.

In the first variation, the determiner 135 performs the following processes when the data set read in step S203 is not the same as the present data set that is the data set stored in the first storage area 137A of the storage unit 137 (No in steps S201, S202, and S205).

The determiner 135 determines whether or not the previously applied correction data related to the data set read in step S203 is stored in the second storage area 137B of the storage unit 137 in step S206. When the determiner 135 determines that the previously applied correction data is stored in the second storage area 137B in step S206 (Yes in step S206), the display control unit 132 functions as the notification unit together with the control panel 60. In order to function as the notification unit, the display control unit 132 controls the control panel 60 to display a message as the execution-related information for inquiring the user whether or not to apply the previously applied correction data stored in the second storage area 137B of the storage unit 137 in step S207.

When the user confirms the message displayed on the control panel 60 and operates the control panel 60 to instruct applying the previously applied correction data (Yes in step S208), the reading and writing unit 136 accesses the storage unit 137. The reading and writing unit 136 reads the previously applied correction data related to the data set read in step S203 from the second storage area 137B of the storage unit 137. Next, in step S214, the main controller 140 applies the read previously applied correction data, and the printer control unit 143 controls the subsequent image forming operations using the image forming conditions corrected by the previously applied correction data, in other words, performs the data reuse control.

On the other hand, when the user instructs not applying the previously applied correction data (No in step S208), the display control unit 132 functions as the notification unit together with the control panel 60. In this case, the display control unit 132 executes the same steps S209 to S213 and S215 as the steps S8 to S12 and S14 in the above-described embodiment illustrated in FIG. 8.

Figure 11A:
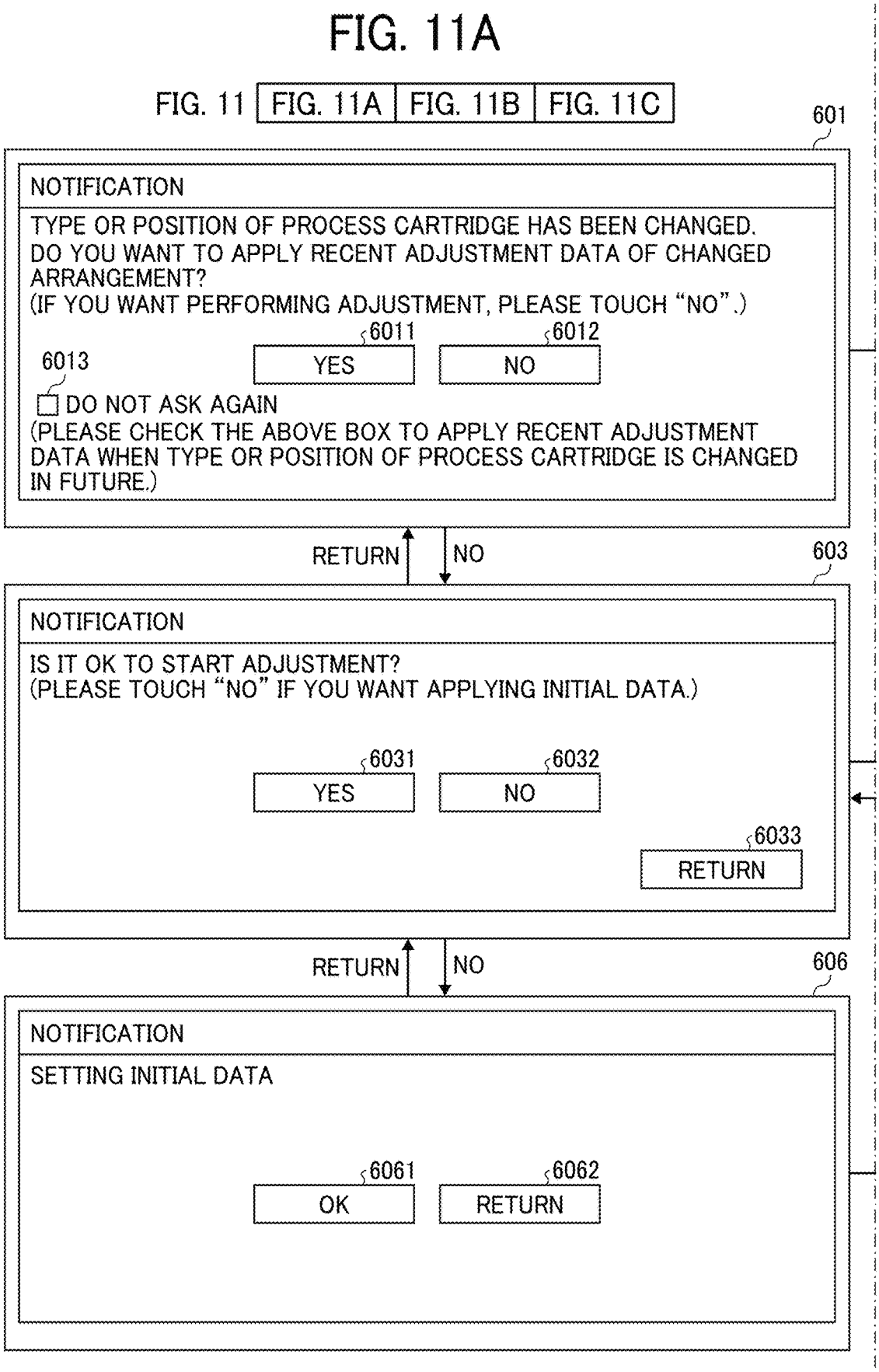
FIGS. 11A, 11B, and 11C is a transition diagram illustrating message screens displayed on a control panel in the first variation.
Figure 11B:
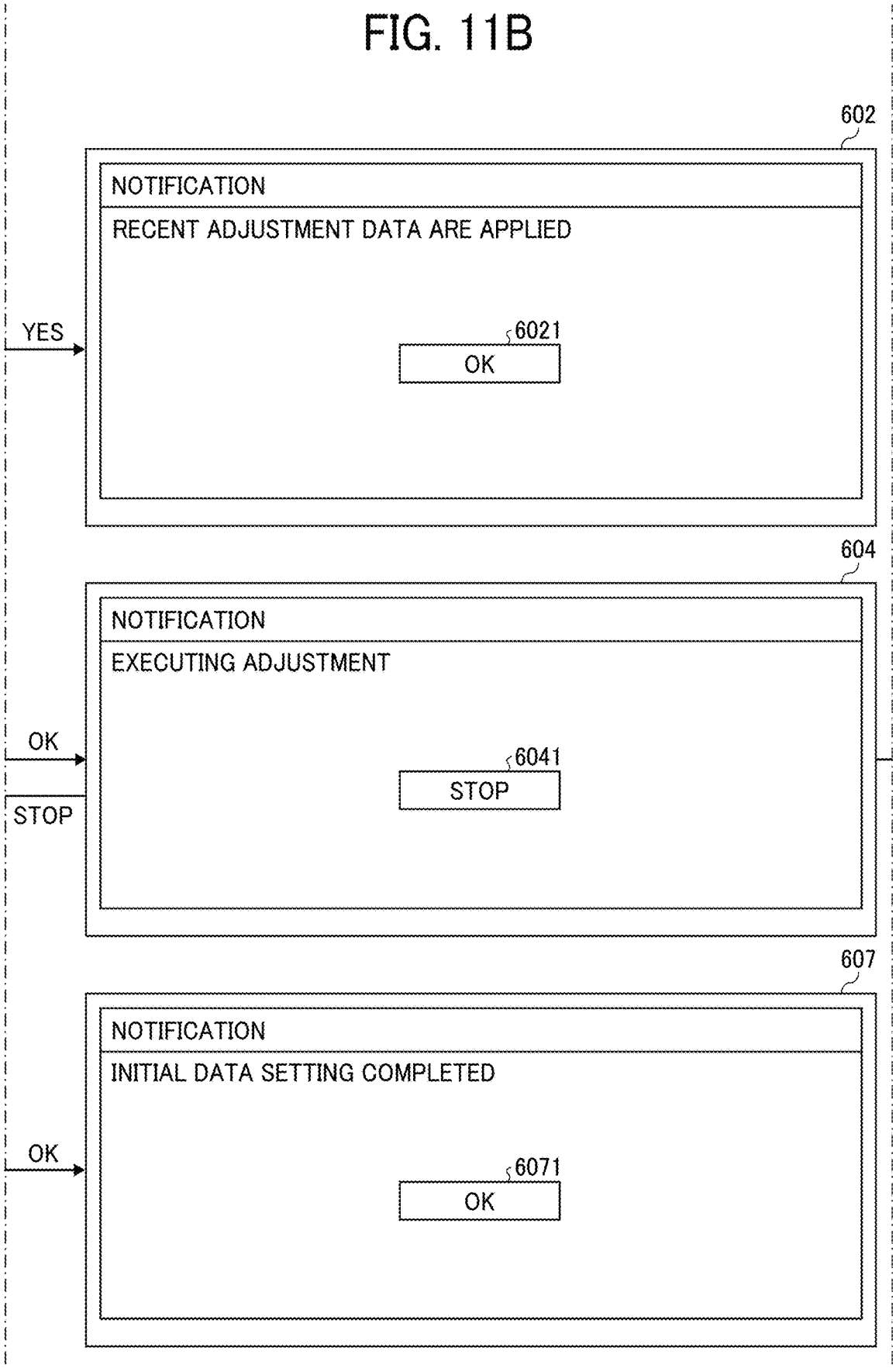
Figure 11C:
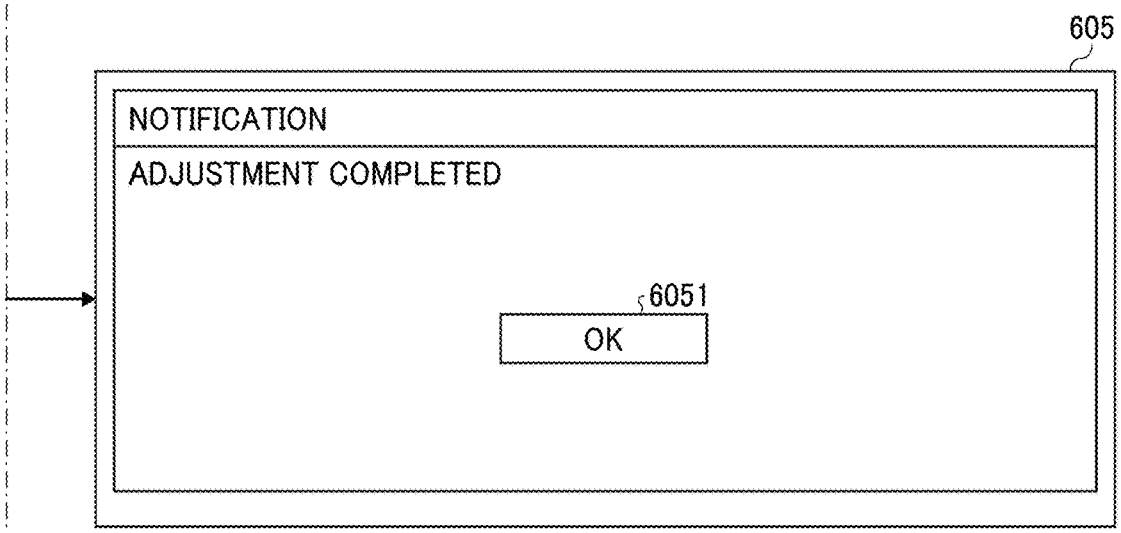

FIG. 11 including FIGS. 11A, 11B, and 11C is a transition diagram illustrating the message screens displayed on the control panel 60 in the first variation.

A screen 601 is an example of the message notified in step S207. When the user touches an icon 6011 displaying "YES" on the screen 601 (Yes in step S208), the screen 601 transitions to a screen 602 displaying a message informing the user applying the previously applied correction data, that is, previous adjustment values. When the user touches an icon 6021 displaying "OK" on the screen 602, the screen 602 transitions to the home screen. If the user wants to always apply the previous adjustment values (the previously applied correction data) when the user changes the type or attachment portion of the image forming unit, the user puts a check mark in a check box 6013. After the user puts the check mark in the check box 6013, the control panel does not display the above messages, and the previous adjustment values are always applied.

When the user touches an icon 6012 displaying "NO" on the screen 601 (No in step S208), the screen 601 transitions to a screen 603 displaying a message inquiring the user whether or not to execute the adjustment (the condition correction processing). A screen 603 is an example of the message notified in step S209. When the user touches an icon 6033 displaying "RETURN" on the screen 603, the screen 603 returns to the screen 601. When the user touches an icon 6031 displaying "YES" on the screen 603 (Yes in step S210), the correction control unit 141 in the main controller 140 performs the adjustment (the condition correction processing) in step S213, and the screen 603 transitions to a screen 604 notifying that adjustment is being executed. When the user touches an icon 6041 displaying "stop" on the screen 604, the correction control unit 141 stops the adjustment operation being executed, and the screen 604 transitions to the screen 603. When the adjustment is completed without touching the "stop" icon 6041 on the screen 604, the screen 604 transitions to a screen 605 for notifying that the adjustment is completed. When the user touches an icon 6051 displaying "OK" on the screen 605, the screen 605 transitions to the home screen.

When the user touches an icon 6032 displaying "NO" on the screen 603 (No in step S210), the screen 603 transitions to a screen 606 confirming the user setting the initial data. When the user touches an icon 6062 displaying "RETURN" on the screen 606, the screen 606 transitions to the screen 603. When the user touches an icon 6061 displaying "OK" on the screen 606, the screen 606 transitions to a screen 607 informing the user setting the initial data. When the user touches an icon 6071 displaying "OK" on the screen 607, the screen 607 transitions to the home screen.

The following describes a second variation of the image forming condition correction processing according to the embodiment described above.

The image forming condition correction processing according to the second variation is different from the image forming condition correction processing according to the first variation in that calculation timing data indicating a timing at which the previously applied correction data is calculated is also displayed in the message notified in step S207 of the image forming condition correction processing according to the first variation.

Figure 12:
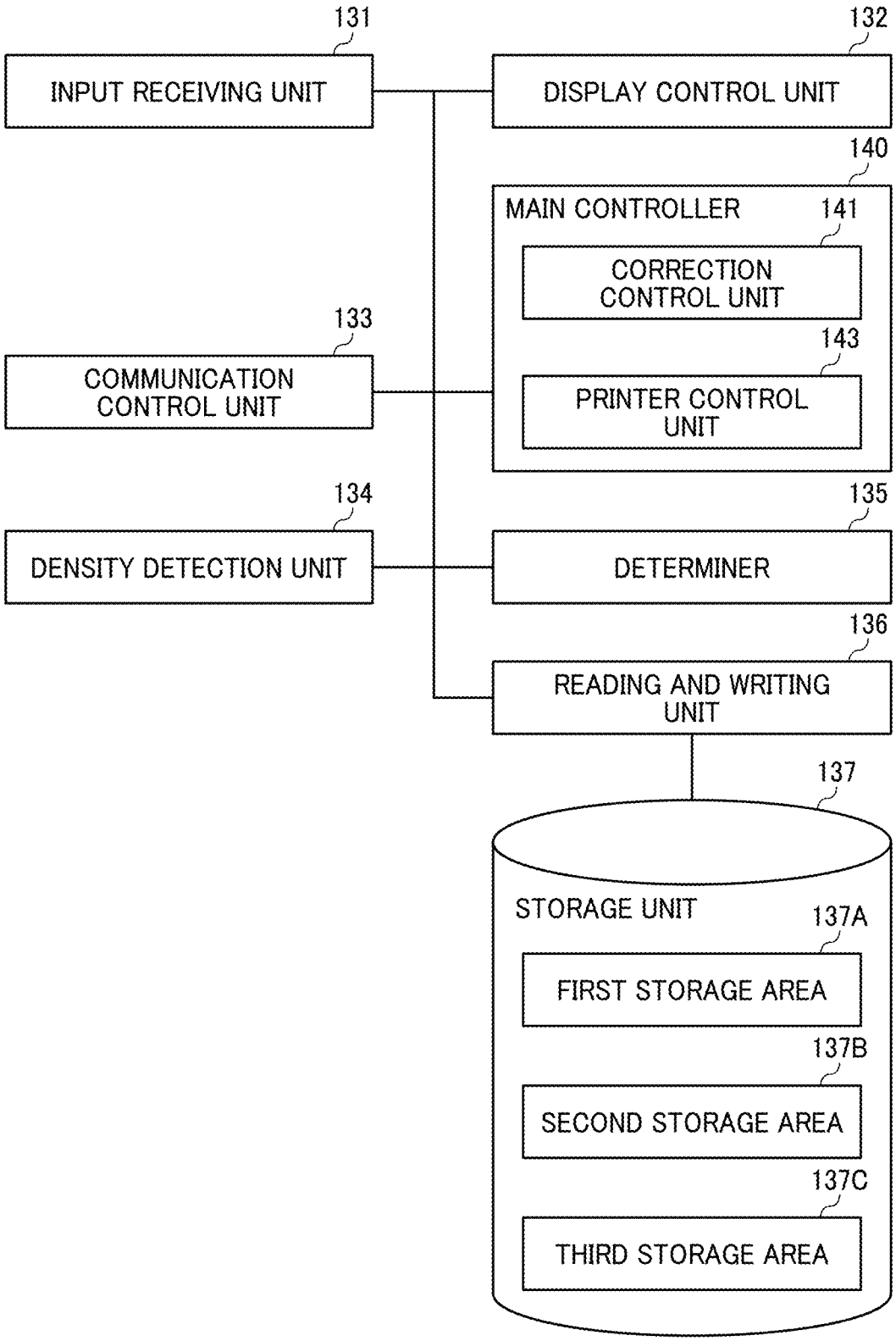
FIG. 12 is a functional block diagram illustrating main functions of the image forming apparatus according to a second variation.

FIG. 12 is a functional block diagram illustrating main functions of the image forming apparatus 1 according to the second variation.

FIG. 13 is an explanatory diagram illustrating an example of a message screen displayed in a process of step S207 in the second variation.

The storage unit 137 in the second variation includes a third storage area 137C in addition to the first storage area 137A and the second storage area 137B to notify the calculation timing data indicating the timing at which the previously applied correction data is calculated as described above. In the third storage area 137C, the storage unit 137 stores data of date and time when the correction control unit 141 performs the condition correction processing for calculating correction data of the image forming conditions. The storage unit 137 stores the data of date and time in association with the data set of the unit identification data of image forming units and the attachment portion identification data of the unit attachment portions on which the image forming units are attached at the time of the condition correction processing.

A screen 608 illustrated in FIG. 13 is another example of the screen 601 illustrated in FIG. 11A. When the determiner 135 determines that the previously applied correction data is stored in the second storage area 137B in step S206 (Yes in step S206), the display control unit 132 functions as the notification unit together with the control panel 60. In order to function as the notification unit, the display control unit 132 controls the control panel 60 to display the data of date and time like a screen 608 illustrated in FIG. 13 in step S207. The date and time displayed in the above is the date and time when the correction control unit 141 in the main controller 140 performs the condition correction processing and calculates the previously applied correction data that is read from the third storage area 137C of the storing unit 137.

According to the second variation, the user can check the elapsed time from the previous adjustment and then select whether to reflect the previous adjustment values or to execute the adjustment. This enables the user to determine an appropriate selection. For example, since the previous adjustment date and time is the previous day, the user can select applying the previous adjustment values, or since the previous adjustment date and time is one week or more ago, the user can instruct performing the adjustment.

Data that is useful for the user to determine whether to execute the condition correction processing is not limited to the data of date and time when the correction control unit 141 performs the condition correction processing and calculates the previously applied correction data, and other data may be employed. For example, the data may be the temperature and humidity at the time when the correction control unit 141 performs the condition correction processing and calculates the previously applied correction data and the type of sheet at the time when the correction control unit 141 performs the condition correction processing and calculates the previously applied correction data.

The following describes a third variation of the image forming condition correction processing according to the embodiment described above.

The image forming condition correction processing according to the third variation is different from the image forming condition correction processing according to the first variation in that notifying the message in the mage forming condition correction processing as described in the first variation is omitted.

Figure 14:
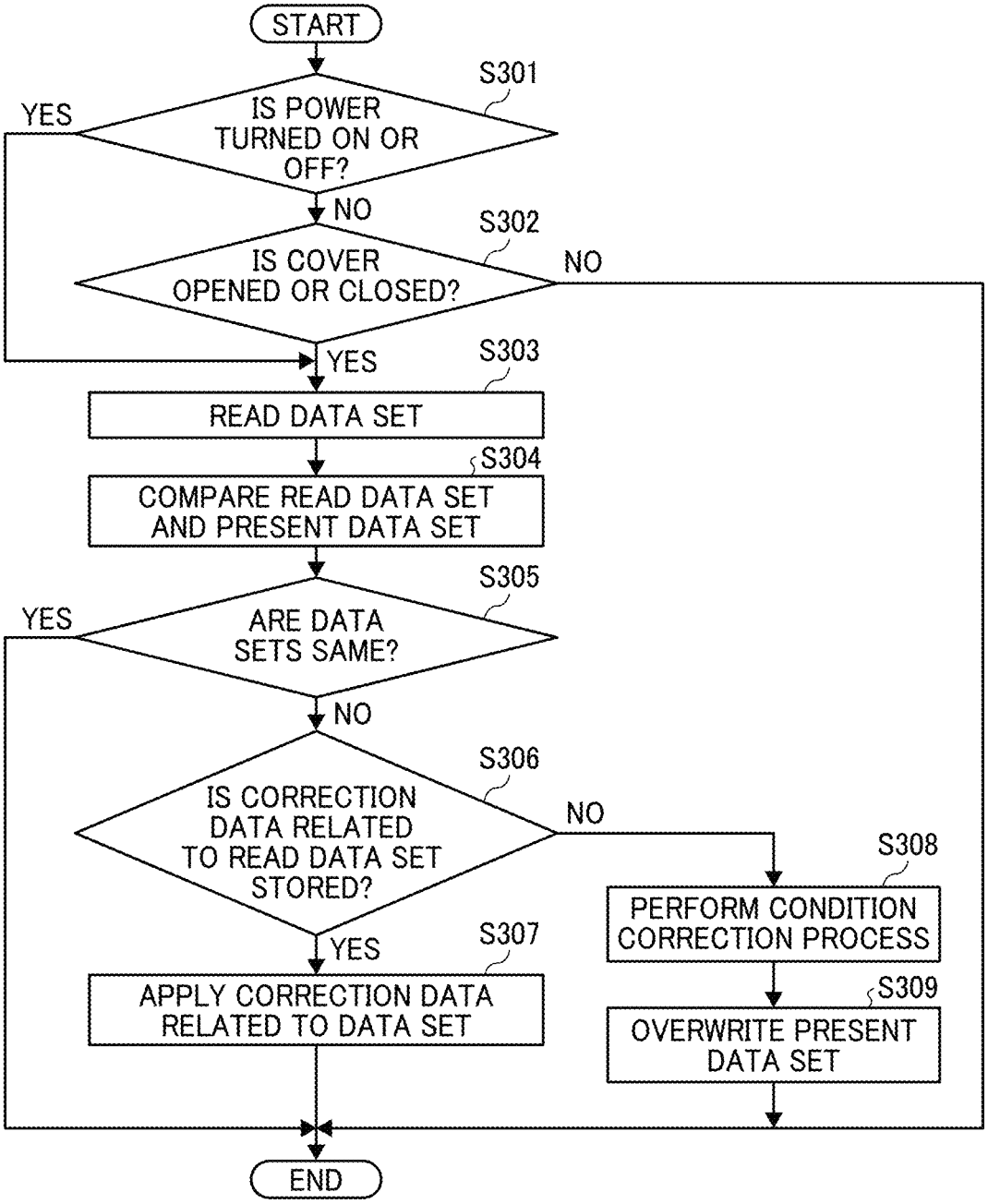
FIG. 14 is a flowchart illustrating processes of correcting image forming conditions according to a third variation.

FIG. 14 is a flowchart illustrating processes of correcting image forming conditions of the image forming apparatus 1 according to the third variation.

In the third variation, the determiner 135 performs the following processes when the data set read in step S303 is not the same as the present data set that is the data set stored in the first storage area 137A of the storage unit 137 (No in steps S301, S302, and S305).

The determiner 135 determines whether or not the previously applied correction data related to the data set read in step S303 is stored in the second storage area 137B of the storage unit 137 in step S306. When the determiner 135 determines the previously applied correction data is stored in step S306 (Yes in step S306), the message notification in step S207 of the image forming condition correction processing in the first variation described above is omitted. The reading and writing unit 136 reads the previously applied correction data related to the data set read in step S203 from the second storage area 137B of the storage unit 137. Next, in step S307, the main controller 140 applies the read previously applied correction data, and the printer control unit 143 controls the subsequent image forming operations using the image forming conditions corrected by the previously applied correction data, in other words, performs the data reuse control.

When the determiner 135 determines the previously applied correction data is not stored in step S306 (No in step S306), the message notification in step S209 of the image forming condition correction processing in the first variation described above is omitted. The correction control unit 141 in the main controller 140 performs the condition correction processing in step S308. The main controller 140 applies correction data newly calculated by the condition correction processing, and the printer control unit 143 controls the subsequent image forming operations using the image forming conditions corrected after the condition correction processing. In addition, the reading and writing unit 136 writes the correction data newly calculated in step S308 as the correction data related to the data set read in step S303 in the second storage area 137B of the storage unit 137 in step S309.

According to the third variation, the user can omit a work to input the instruction, and deterioration in image quality can be prevented.

The following describes the condition correction processing in the present embodiment.

Figure 15:
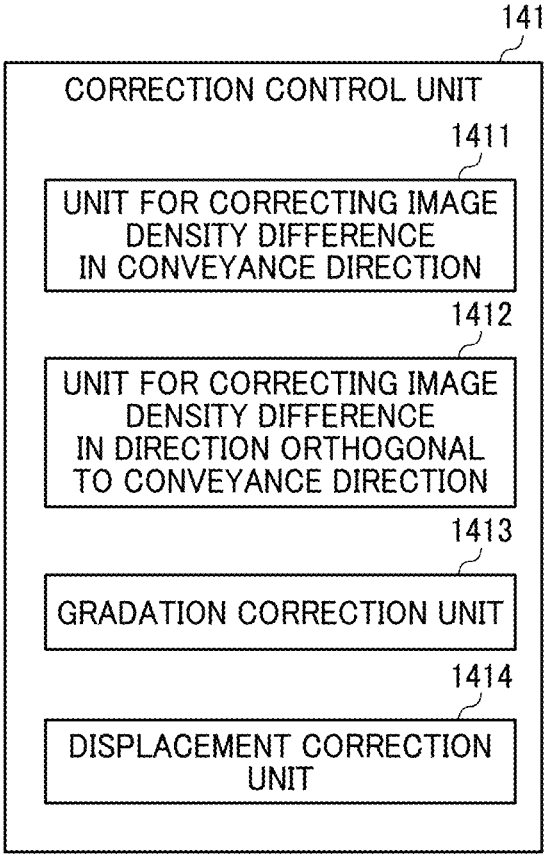
FIG. 15 is a functional block diagram illustrating an example of image quality adjustment functions of a correction control unit in the image forming apparatus to correct the image forming conditions.

FIG. 15 is a functional block diagram illustrating an example of adjustment functions of the correction control unit 141 to correct the image forming conditions.

The correction control unit 141 according to the present embodiment includes a unit for correcting an image density difference in the sheet conveyance direction 1411, a unit for correcting an image density difference in the direction orthogonal to the sheet conveyance direction 1412, a gradation correction unit 1413, and a displacement correction unit 1414.

The unit for correcting an image density difference in the sheet conveyance direction 1411 executes control for correcting the image density difference when the image density difference of the image formed on the sheet P occurs in the conveyance direction of the sheet P. Specifically, the unit for correcting the image density difference in the sheet conveyance direction 1411 outputs correction data for correcting the image density difference based on the detection result of a conveyance-direction image-density-difference correction pattern formed on the sheet P detected by the image density sensor 70. Examples of correcting the image density difference include, but are not limited to, adjusting the toner concentration of the developer in the developing device 114, adjusting the developing bias or the charging bias, and adjusting the writing light amount.

The unit for correcting the image density difference in the direction orthogonal to the sheet conveyance direction 1412 executes control for correcting the image density difference when the image density difference of the image formed on the sheet P occurs in the direction (orthogonal direction) orthogonal to the conveyance direction of the sheet P. Specifically, the unit for correcting the image density difference in the direction orthogonal to the sheet conveyance direction 1412 outputs correction data for correcting the image density difference based on the detection result of an orthogonal-direction image-density-difference correction pattern formed on the sheet P detected by the image density sensor 70. Examples of correcting the image density difference include, but are not limited to, adjusting the toner concentration of the developer in the developing device 114, adjusting the developing bias or the charging bias, and adjusting the writing light amount.

The gradation correction unit 1413 executes control for correcting gradations when an abnormality occurs in a gradation pattern formed on the sheet P. Specifically, the gradation correction unit 1413 outputs correction data for correcting the gradations based on the detection result of an image gradation correction (calibration) pattern formed on the sheet P detected by the image density sensor 70. Examples of correcting the gradations include, but are not limited to, adjusting the toner concentration of the developer in the developing device 114, adjusting the developing bias or the charging bias, and adjusting the writing light amount.

The displacement correction unit 1414 executes control for bringing an actual image position closer to an ideal image position when a difference occurs between the actual image position formed on the sheet P and the ideal image position at which the original image is to be formed. Specifically, the displacement correction unit 1414 outputs a condition for correcting the actual image position based on the detection result of an image displacement correction pattern formed on the sheet P detected by the image density sensor 70. Examples of the correction of the image position include, but are not limited to, correcting an image writing start position and adjusting a leading edge margin by controlling timing of feeding a sheet between the intermediate transfer belt 116 and the secondary transfer device 118.

To correct the image position, for example, a function of offsetting all image positions from the actual image positions to the ideal image positions may be used. In addition, a magnification adjustment function and a skew correction function may be used. The magnification function enlarges or reduces an image to bring the actual image position close to the ideal image position. The skew correction function inclines the actual image position to bring the actual image position close to the ideal image position. A front and back image position adjustment function may be also used. The front and back image position adjustment function forms image position adjustment marks not only on the first surface (front surface) but also on the second surface (back surface) of the sheet P and aligns the image positions of the front and back surfaces using actual image position data of the front and back surfaces.

FIGS. 16A to 16D are explanatory diagrams illustrating examples of correction patterns that can be used to correct the image density difference and the gradations.

Figure 16A:
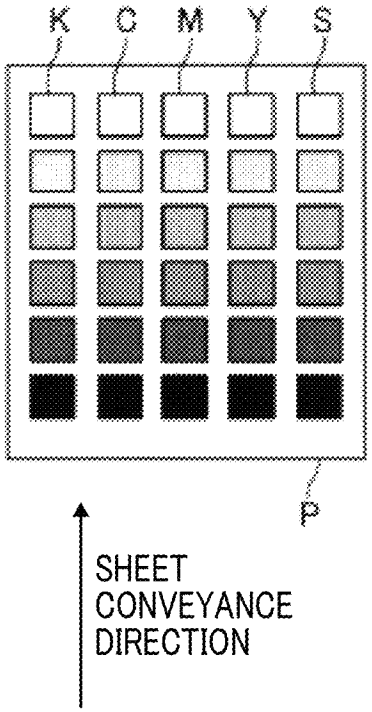
FIGS. 16A to 16D are explanatory diagrams illustrating examples of correction patterns that can be used to correct an image density difference or image density gradations.

The image gradation correction pattern is, for example, a pattern as illustrated in FIG. 16A in which gradation patches of black (K), cyan (C), magenta (M), yellow (Y), and spot color (S) are formed in a stepwise manner. FIG. 16A illustrates an example in which the patches of K, C, M, Y, and S are simultaneously formed with the same gradations. Note that the shape, number, layout, and the like of the formed patches are not limited thereto. For example, the number of output sheets may be two or more. The shape, number, gradations, and layout of patches may be different between the toner-adhesion-amount correction pattern and the gradation correction pattern.

Figure 16B:
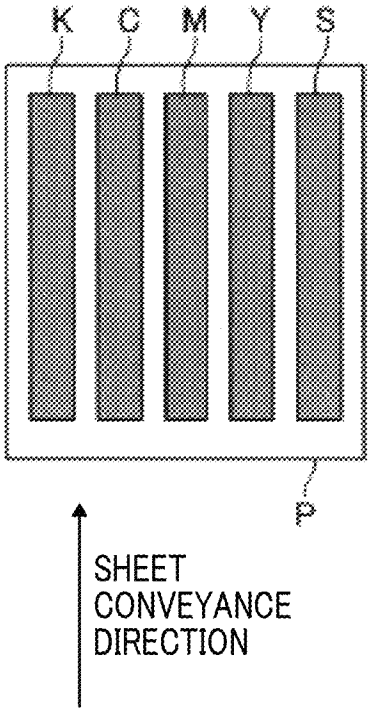

The conveyance-direction image-density-difference correction pattern is, for example, a pattern as illustrated in FIG. 16B including patches each having one of black (K), cyan (C), magenta (M), yellow (Y), and spot color (S) and a long shape extending in the sheet conveyance direction. FIG. 16B illustrates an example in which the patches of K, C, M, Y, and S are simultaneously formed with the same gradations. Note that the shape, number, layout, and the like of the formed patches are not limited thereto. For example, the number of output sheets may be two or more.

Figure 16C:
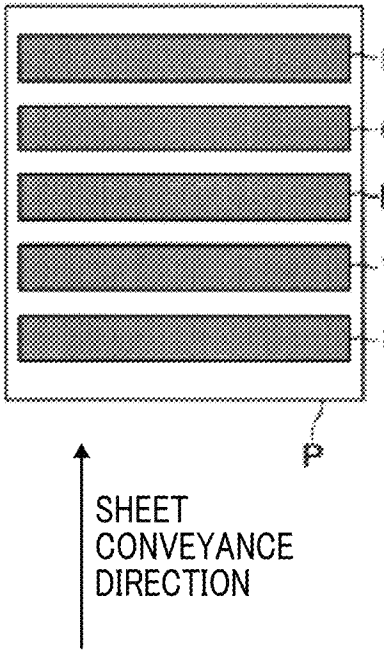

The orthogonal-direction image-density-difference correction pattern is, for example, a pattern as illustrated in FIG. 16C including patches each having one of black (K), cyan (C), magenta (M), yellow (Y), and spot color (S) and a long shape extending in the direction orthogonal to the sheet conveyance direction. FIG. 16C illustrates an example in which the patches of K, C, M, Y, and S are formed with the same gradations. Note that the shape, number, layout, and the like of the formed patches are not limited thereto. For example, the number of output sheets may be two or more.

Figure 16D:
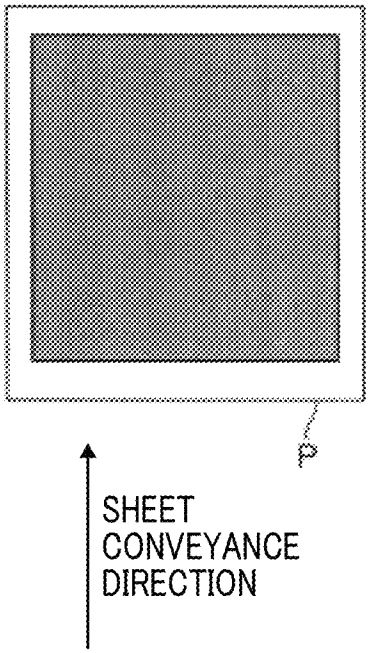

Further, the correction of the image density difference in the sheet conveyance direction and the correction of the image density difference in the orthogonal direction can be simultaneously performed using the entire solid image as illustrated in FIG. 16D. In such a case, the entire solid images of K, C, M, Y, and S with several gradations may be output over a plurality of sheets to calculate the correction values for the respective colors.

Figure 17A:
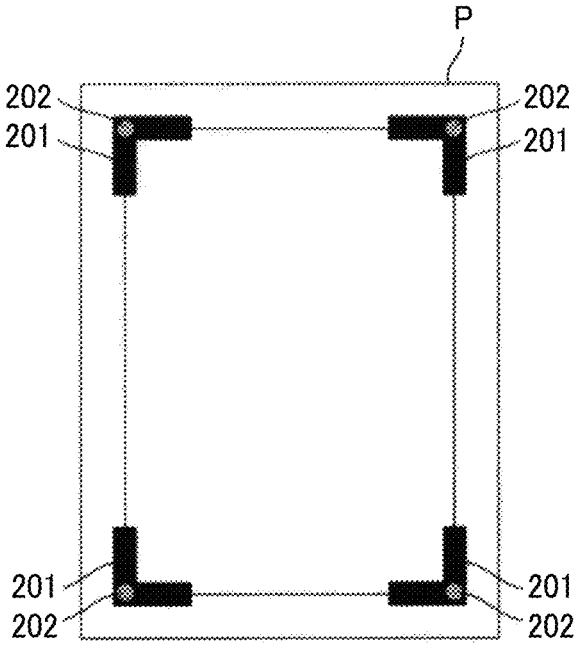
FIGS. 17A and 17B are explanatory diagrams illustrating an example of correction patterns (correction marks) that can be used for image displacement correction.
Figure 17B:
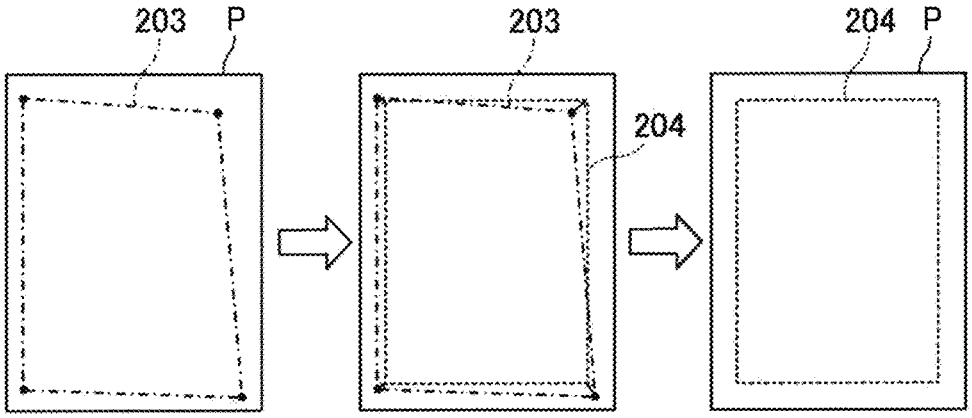

FIGS. 17A and 17B are explanatory diagrams illustrating an example of correction patterns (correction marks) that can be used for image displacement correction.

FIG. 17A illustrates the sheet P on which the image displacement correction marks 201 are printed. To perform the image displacement correction, the image forming apparatus 1 forms, for example, at least one image displacement correction mark 201 in addition to the image formed based on the input image data on at least one place (four places in the present embodiment) of the sheet P. The storage unit 137 in the image forming apparatus 1 stores image data of the correction mark 201 in advance. Then, the printer engine 100 forms an image on the sheet P based on the input image data in addition to the image data of the correction mark 201 for image misregistration correction. When images are formed on both surfaces of the sheet P, the correction mark 201 may be formed not only on the first surface of the sheet P but also on the second surface which is the back surface of the first surface.

The correction mark 201 for the image misregistration correction has, for example, an L-shape as illustrated in FIG. 17A and is printed near each of the four corners of the sheet P. The correction mark 201 may have any shape that can be detected by the image density sensor 70. For example, the correction mark may have a cross shape or rectangular shape. The number and arrangement of the correction marks 201 printed on the sheet P are not limited to those illustrated in FIG. 17A.

The displacement correction unit 1414 acquires coordinate data of a total of eight points including four corners of the sheet P and the center coordinates 202 of the four printed correction marks 201 illustrated in FIG. 17A from the detection results (read image data) detected by the image density sensor 70. The actual image position can be acquired from the coordinate data of the eight points.

The displacement correction unit 1414 performs processes illustrated in FIG. 17B. After the displacement correction unit acquires actual image positions 203, the displacement correction unit 1414 calculates, as correction data, an amount by which the image is to be moved so as to approach the ideal image positions 204 to be originally formed. In FIG. 17B, the actual image positions 203 are indicated by an alternate long and short dash line, and the ideal image positions 204 are indicated by a dotted line.

When the spot color toner S is a white toner or a transparent toner, it may be difficult for the image density sensor 70 to appropriately detect the correction pattern formed on the white sheet P. In such a case, a configuration that forms and detects the correction pattern on the non-white (for example, black) intermediate transfer belt 116 appropriately and easily detects the correction pattern. On the other hand, when the spot color toner S is colored toner such as gold or fluorescent color, the image density sensor 70 can appropriately detects the correction pattern formed on the white sheet P. Of course, the image forming apparatus using black (K) toner, cyan (C) toner, magenta (M) toner, yellow (Y) toner, and the spot color toner such as gold toner or fluorescent toner may adopt the configuration that forms the correction pattern of the intermediate transfer belt 116.

The above-described change of the image forming unit in the embodiment is the replacement of units configured as the image forming unit for the spot color toner, in the other words, the change about the station on which the image forming unit for the spot color toner is set, but the present disclosure may be applied to another case. For example, the present disclosure may be applied to replacement of some of the image forming units using general color toners such as the yellow toner, the magenta toner, the cyan toner, and the black toner, in other words, the change about the stations on which the image forming units for the general color toners. In the above-described embodiment, the number of the plurality of replaceable units is three but may be two or four or more.

In addition, the above-described embodiment is applied to the copier but may be applied to the printer. In this case, an image formation startable state is a state in which a print instruction can be received by displaying a message indicating that printing is possible on the control panel of the printer or transmitting a signal indicating that printing is possible to a higher-level device such as a computer to which the printer is connected.

The above-described embodiment and variations are examples and attain advantages below in a plurality of aspects.

First Aspect

An image forming apparatus according to a first aspect such as the image forming apparatus 1 includes a plurality of image forming units such as the plurality of image forming units 101S, 101C, 101M, 101Y, and 101K, a plurality of unit attachment portions such as the plurality of unit attachment portions 120-1 to 120-5, an acquisition unit such as the reading and writing unit 136, a calculator such as the correction control unit 141, a controller such as the printer control unit 143, and a notification unit such as the display control unit 132 and the control panel 60.

The plurality of image forming units have unit identification data, and are configured to be attached to the plurality of unit attachment portions. The plurality of unit attachment portions are configured to have attachment portion identification data. The acquisition unit is configured to acquire data set of the unit identification data of the plurality of image forming units and the attachment portion identification data of the plurality of unit attachment portions. The calculator is configured to calculate calculation data that include at least one of correction data for correcting image forming conditions of the plurality of image forming units or data on corrected image forming conditions. The calculator may calculate only the correction data or only the image forming conditions. The calculator may calculate both the correction data and the image forming conditions. The controller is configured to control the plurality of image forming units using the calculation data. The storage unit is configured to store the data set and the calculation data corresponding to the data set so as to be related to each other. When the data set is changed (for example, NO in step S5 in FIG. 8, NO in step S205 in FIG. 10, and NO in step S305 in FIG. 14), and when the storage unit stores the calculation data corresponding to the changed data set (for example, YES in step S7 in FIG. 8, YES in step S206 in FIG. 10, and YES in step S306 in FIG. 14), the controller is configured to execute the data reuse control of controlling the plurality of image forming units using the calculation data that are stored in the storage unit and correspond to the data set acquired by the acquisition unit (for example, step S13 in FIG. 8, step S214 in FIG. 10, and step S307 in FIG. 14). The notification unit is configured to notify execution-related information on execution of the data reuse control before the controller executes the data reuse control.

In the present disclosure, exchanging or replacing the image forming units changes the data set acquired by the acquisition unit. At this time, when the storage unit stores the calculation data corresponding to the data set after the data set is changed, the controller executes the data reuse control for controlling the image forming unit using the calculation data stored in the storage unit. Thus, the controller controls the image forming unit using the image forming conditions corrected corresponding to the image forming unit at the attachment portion after the exchange or the replacement.

Moreover, the notification unit of the present disclosure notifies the execution-related information on execution of the data reuse control before the controller executes the data reuse control. As a result, when the user exchanges the image forming units or replace the image forming unit, the user receives the above notification and can recognize that the controller controls the image forming unit using the image forming conditions corrected corresponding to the image forming unit at the attachment portion after the exchange or the replacement. The notification can prevent the user from instructing to execute the useless operation that corrects image forming conditions even though the controller can control the image forming unit using image forming conditions corrected corresponding to the image forming unit at the attachment portion after the exchange or the replacement.

Second Aspect

In a second aspect, the image forming apparatus according to the first aspect further includes an input receiving unit such as the input receiving unit 131 that receives an instruction input regarding the data reuse control. The notification unit is configured to notify a selection information as the execution-related information on whether to execute the data reuse control (for example, in step S207 in FIG. 10), and the controller is configured to execute the data reuse control when the input receiving unit receives an instruction executing the data reuse control and not to execute the data reuse control when the input receiving unit receives an instruction not executing the data reuse control.

According to the second aspect, since the user can select whether or not to execute the data reuse control as in the first variation, user convenience is improved.

Third Aspect

In a third aspect, the image forming apparatus according to the second aspect includes the storage unit configured to store useful determination information (for example, the calculation timing data indicating a timing at which the previously applied calculation data is calculated) that is useful for determination regarding whether to execute the data reuse control so as to relate the data set and the calculation data to the useful determination information and the notification unit configured to notify the useful determination information as the execution related information.

According to the third aspect, the convenience for the user is further improved because the user can select whether to execute the data reuse control considering the useful determination information such as a type of sheet, temperature, humidity, and timing when the calculator previously calculates the calculation data used in the data reuse control as described in the second variation.

Fourth Aspect

In a fourth aspect, the image forming apparatus according to any one of the first to third aspects includes the notification unit including a display such as the control panel 60.

According to the fourth aspect, the image forming apparatus can smoothly notify the execution-related information to the user.

Fifth Aspect

In a fifth aspect, the image forming apparatus according to any one of the first to fourth aspects includes the notification unit configured to notify non-existence information (for example, the warning massage displayed by the screen 609 in FIG. 9) when the storage unit does not store the calculation data corresponding to the data set acquired by the acquisition unit after the data set is changed.

According to the fifth aspect, the user notified of the non-existence information can determine whether to execute the condition correction processing to improve the image quality or to use alternative calculation data such as the initial data to immediately form the image.

Sixth Aspect

In a sixth aspect, the image forming apparatus according to the fifth aspect further includes an input receiving unit such as the input receiving unit 131 configured to receive an instruction input. In addition, the notification unit is configured to notify a selection information as the non-existence information to select whether to calculate the calculation data (for example, step S8 in FIG. 9 or step S209 in FIG. 10). When the input receiving unit receives an instruction for calculating the calculation data, the calculator is configured to calculate the calculation data (for example, step S12 in FIG. 9 or step S213 in FIG. 10). When the input receiving unit receives an instruction for not calculating the calculation data, the calculator is configured not to calculate the calculation data.

According to the sixth aspect, the user can receive the selection information to select whether to calculate the calculation data and input the instruction input to the input receiving unit. Based on the instruction input, the image forming apparatus can execute the condition correction processing to improve the image quality or use the alternative calculation data such as the initial data to immediately form the image.

Seventh Aspect

In a seventh aspect, the image forming apparatus according to any one of the first to fifth aspects includes the calculator configured to calculate the calculation data without receiving an instruction input when the storage unit does not store the calculation data corresponding to the data set acquired by the acquisition unit after the data set is changed (for example, NO in step S305 in FIG. 14).

According to the seventh aspect, the user can omit the work to input the instruction, and deterioration in the image quality can be prevented as described in the third variation.

Eighth Aspect

An image forming apparatus according to an eighth aspect such as the image forming apparatus 1 includes a plurality of image forming units such as the plurality of image forming units 101S, 101C, 101M, 101Y, and 101K, a plurality of unit attachment portions such as the plurality of unit attachment portions 120-1 to 120-5, an acquisition unit such as the reading and writing unit 136, a calculator such as the correction control unit 141, a controller such as the printer control unit 143.

The plurality of image forming units have unit identification data and are configured to be attached to the plurality of unit attachment portions. The plurality of unit attachment portions are configured to have attachment portion identification data. The acquisition unit is configured to acquire data set of the unit identification data of the plurality of image forming units and the attachment portion identification data of the plurality of unit attachment portions. The calculator is configured to calculate calculation data that include at least one of correction data for correcting image forming conditions of the plurality of image forming units or data on corrected image forming conditions. The calculator may calculate only the correction data or only the image forming conditions. The calculator may calculate both the correction data and the image forming conditions. The controller is configured to control the plurality of image forming units using the calculation data. The storage unit is configured to store the data set and the calculation data corresponding to the data set so as to be related to each other. When the data set is changed (for example, NO in step S305 of FIG. 14), and when the storage unit does not store the calculation data corresponding to the data set acquired by the acquisition unit (for example, NO in step S306 of FIG. 14), the calculator is configured to calculate the calculation data without receiving an instruction input (for example, step S308 of FIG. 14).

According to the eighth aspect, the user can omit the work to input the instruction, and deterioration in the image quality can be prevented as described in the third variation.

Ninth Aspect

In a ninth aspect, the image forming apparatus according to any one of the first to eighth aspects includes the storage unit including the non-volatile storage medium such as the EEPROM 102. For example, at least one of the first storage area 137A, the second storage area 137B, and the third storage area 137C may be the non-volatile storage medium.

According to the ninth aspect, the storage unit can hold the stored data even if the power supply of the image forming apparatus is turned off.

Tenth Aspect

In a tenth aspect, each of the plurality of image forming units in the image forming apparatus according to any one of the first to ninth aspects includes at least a part of the storage unit.

According to the tenth aspect, the amount of data stored in a memory of the image forming apparatus main body can be reduced.

Eleventh Aspect

In an eleventh aspect, the image forming apparatus according to any one of the first to the tenth aspects further includes a detection unit such as the image density detection unit 134 configured to detect an image formed by at least one of the plurality of image forming units. In addition, the calculator is configured to calculate the calculation data of the at least one of the plurality of image forming units based on detection data detected by the detection unit.

According to the eleventh aspect, the image forming apparatus can form an appropriate image under the image forming condition corrected based on the actual image formed using the image forming unit.

Twelfth Aspect

In a twelfth aspect, the calculator in the image forming apparatus according to the eleventh aspect is configured to calculate the calculation data to correct an image density difference of the image in the conveyance direction of the recording medium.

According to the twelfth aspect, the image forming apparatus can reduce the image density difference in the conveyance direction of a recording medium to form the appropriate image.

Thirteenth Aspect

In a thirteenth aspect, the calculator in the image forming apparatus according to the eleventh aspect or the twelfth aspect is configured to calculate the calculation data to correct an image density difference of the image in the direction orthogonal to the conveyance direction of the recording medium.

According to the thirteenth aspect, the image forming apparatus can reduce the image density difference in the direction orthogonal to the conveyance direction of a recording medium to form the appropriate image.

Fourteenth Aspect

In a fourteenth aspect, the calculator in the image forming apparatus according to the eleventh to thirteenth aspects is configured to calculate the calculation data to correct gradations of the image formed by the at least one of the image forming units.

According to the fourteenth aspect, the image forming apparatus can reduce the difference between target gradations and actual gradations to form the appropriate image.

Fifteenth Aspect

In a fifteenth aspect, the calculator in the image forming apparatus according to the eleventh to fourteenth aspects is configured to calculate the calculation data to correct the actual image position of the image formed by the at least one of the image forming units to the ideal image position at which the original image is to be formed.

According to the fifteenth aspect, the image forming apparatus can reduce the difference between the actual image position and the ideal image position to form the appropriate image.

Sixteenth Aspect

In a sixteenth aspect, the image forming apparatus according to any one of the first to fifteenth aspects includes, as the plurality of unit attachment portions, five or more unit attachment portions such as the unit attachment portions 120-1 to 120-5 and, as the plurality of image forming units, four image forming units using the black toner, the cyan toner, the magenta toner, and the yellow toner, respectively, such as the image forming units 101C, 101M, 101Y, and 101K and one or more image forming units using toner different from the black toner, the cyan toner, the magenta toner, and the yellow toner, such as the image forming unit 101S.

According to the sixteenth aspect, the image forming apparatus can provide the image having various values using the spot color toner different from the black toner, the cyan toner, the magenta toner, and the yellow toner. The image forming unit including the spot color toner is frequently exchanged or replaced. The image forming apparatus according to the present disclosure can prevent the calculator from performing the useless operation.

Seventeenth Aspect

In a seventeenth aspect, the image forming apparatus according to any one of the first to sixteenth aspects includes two or more of the plurality of image forming units are exchangeable between two or more of the plurality of unit attachment portions.

According to the seventeenth aspect, the image forming apparatus in which the image forming units can exchange between the unit attachment portions can prevent the calculator from performing the useless operation.

Eighteenth Aspect

In an eighteenth aspect, an image forming system includes the image forming apparatus. In addition, the image forming system includes the acquisition unit, the calculator, the storage unit, the controller, and the notification unit that have the same configuration as the acquisition unit, the calculator, the storage unit, the controller, and the notification unit in the first aspect. The image forming apparatus includes a plurality of image forming units having unit identification data and a plurality of unit attachment portions having attachment portion identification data. The plurality of image forming units are configured to be detachably attached to the plurality of unit attachment portions.

Any one of the acquisition unit, the calculator, the storage unit, the controller, and the notification unit may not be in the image forming apparatus. For example, an external device outside the image forming apparatus, such as a personal computer or a server may include the acquisition unit, the calculator, the storage unit, the controller, and the notification unit. If the external device includes a CPU, the external device can function as any one of the acquisition unit, the calculator, the storage unit, the controller, and the notification unit. The external device may be coupled to a plurality of image forming apparatuses.

The plurality of image forming units are not limited to the above-described process cartridges. Each image forming unit may have the image formation property in the image forming unit, such as the toner color specific to the image forming unit. The image forming unit may include a toner bottle, a toner supply pipe, and the above-described process cartridge. The image forming unit may be a configuration including a nozzle of an inkjet printer that ejects monochromatic ink. The unit attachment portion is a portion to which the image forming unit is attached.

In the image forming apparatus 1 according to the above-described embodiment, the non-volatile storage media that are included in the plurality of image forming units, respectively store the unit identification data, and the data communication units that are included in the plurality of unit attachment portions, respectively provide the attachment portion identification data. However, the present disclosure is not limited to this. The unit identification data and the attachment portion identification data may be provided so that the controller in the image forming apparatus can recognize which image forming unit is attached to which unit attachment portion. For example, a mechanical configuration may provide the unit identification data and the attachment portion identification data. As such a mechanical configuration, a projection disposed at a position depending on the image formation property on the image forming unit pushes one of switches disposed at positions each of which is unique to each attachment portion such that the controller in the image forming apparatus can identify the attachment portion to which the image forming unit is attached.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a plurality of image formers having unit identification data;

a plurality of unit attachment structures having attachment structure identification data, the plurality of unit attachment structures to which the plurality of image formers are detachably attached;

an acquirer to acquire a data set of the unit identification data of the plurality of image formers and the attachment structure identification data of the plurality of unit attachment structures;

a calculator to calculate calculation data that include at least one of correction data for correcting image forming conditions of the plurality of image formers or data on corrected image forming conditions;

a storage to store the data set and the calculation data corresponding to the data set so as to be related to each other;

a controller configured to execute a data reuse control of controlling the plurality of image formers using the calculation data that are stored in the storage and correspond to the data set acquired by the acquirer after the data set is changed; and a notifier to notify execution-related information on execution of the data reuse control before the controller executes the data reuse control.

2. The image forming apparatus according to claim 1, further comprising an input receiver to receive an instruction input regarding the data reuse control, wherein the notifier notifies selection information as the execution-related information on whether to execute the data reuse control, and wherein the controller is configured to execute the data reuse control when the input receiver receives an instruction for executing the data reuse control and not to execute the data reuse control when the input receiver receives an instruction for not executing the data reuse control.

3. The image forming apparatus according to claim 2, wherein the storage stores useful determination information that is useful for determination regarding whether to execute the data reuse control so as to relate the data set and the calculation data to the useful determination information, and wherein the notifier notifies the useful determination information as the execution-related information.

4. The image forming apparatus according to claim 1, wherein the notifier includes a display.

5. The image forming apparatus according to claim 1, wherein the notifier notifies non-existence information when the storage does not store the calculation data corresponding to the data set acquired by the acquirer after the data set is changed.

6. The image forming apparatus according to claim 5, further comprising an input receiver to receive an instruction input, wherein the notifier notifies selection information as the non-existence information to select whether to calculate the calculation data, and wherein the calculator calculates the calculation data when the input receiver receives an instruction for calculating the calculation data and not to calculate the calculation data when the input receiver receives an instruction for not calculating the calculation data.

7. The image forming apparatus according to claim 1, wherein the calculator calculates the calculation data without receiving an instruction input when the storage does not store the calculation data corresponding to the data set acquired by the acquirer after the data set is changed.

8. The image forming apparatus according to claim 1, wherein the storage includes a non-volatile storage medium.

9. The image forming apparatus according to claim 1, wherein each of the plurality of image formers includes at least a part of the storage.

10. The image forming apparatus according to claim 1, further comprising a detector to detect an image formed by at least one of the plurality of image formers, wherein the calculator calculates the calculation data of the at least one of the plurality of image formers based on detection data detected by the detector.

11. The image forming apparatus according to claim 10, wherein the calculator calculates the calculation data to correct an image density difference of the image in a conveyance direction of a recording medium.

12. The image forming apparatus according to claim 10, wherein the calculator calculates the calculation data to correct an image density difference of the image in a direction orthogonal to a conveyance direction of a recording medium.

13. The image forming apparatus according to claim 10, wherein the calculator calculates the calculation data to correct gradations of the image formed by the at least one of the image formers.

14. The image forming apparatus according to claim 10, wherein the calculator calculates the calculation data to perform an image displacement correction of the image formed by the at least one of the image formers.

15. The image forming apparatus according to claim 1, wherein the plurality of unit attachment structures are five or more unit attachment structures, and the plurality of image formers include four image formers using black toner, cyan toner, magenta toner, and yellow toner, respectively, and one or more image formers using toner different from the black toner, the cyan toner, the magenta toner, and the yellow toner.

16. The image forming apparatus according to claim 1, wherein two or more of the plurality of image formers are exchangeable between two or more of the plurality of unit attachment structures.

17. An image forming apparatus comprising:

a plurality of image formers having unit identification data;

a plurality of unit attachment structures having attachment structure identification data, the plurality of unit attachment structures to which the plurality of image formers are detachably attached;

an acquirer to acquire a data set of the unit identification data of the plurality of image formers and the attachment structure identification data of the plurality of unit attachment structures;

a calculator to calculate calculation data that include at least one of correction data for correcting image forming conditions of the plurality of image formers or data on corrected image forming conditions;

a storage to store the data set and the calculation data corresponding to the data set so as to be related to each other; and a controller configured to control the plurality of image formers using the calculation data, wherein the calculator calculates the calculation data without receiving an instruction input when the storage does not store the calculation data corresponding to the data set acquired by the acquirer after the data set is changed.

18. An image forming system comprising:

an image forming apparatus including:

a plurality of image formers having unit identification data; and a plurality of unit attachment structures having attachment structure identification data, the plurality of unit attachment structures to which the plurality of image formers are detachably attached;

an acquirer to acquire a data set of the unit identification data of the plurality of image formers and the attachment structure identification data of the plurality of unit attachment structures;

a calculator to calculate calculation data that include at least one of correction data for correcting image forming conditions of the plurality of image formers or data on corrected image forming conditions;

a storage to store the data set and the calculation data corresponding to the data set so as to be related to each other;

a controller configured to execute a data reuse control of controlling the plurality of image formers using the calculation data that are stored in the storage and correspond to the data set acquired by the acquirer after the data set is changed; and a notifier to notify execution-related information on execution of the data reuse control before the controller executes the data reuse control.

* * * * *